US009108761B2

(12) United States Patent
Fitzwater et al.

(10) Patent No.: US 9,108,761 B2
(45) Date of Patent: Aug. 18, 2015

(54) CARTON WITH RECLOSABLE FITMENT

(71) Applicant: Graphic Packaging International, Inc., Atlanta, GA (US)

(72) Inventors: Kelly R. Fitzwater, Lakewood, CO (US); Scott Thomas Strand, Lake Elmo, MN (US); Duane R. Mode, Bloomington, MN (US); Sharon Weaver, Chicago, IL (US); Norman L. Jesch, Golden, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 63 days.

(21) Appl. No.: 13/948,644

(22) Filed: Jul. 23, 2013

(65) Prior Publication Data

US 2013/0306717 A1 Nov. 21, 2013

Related U.S. Application Data

(63) Continuation of application No. PCT/US2012/022458, filed on Jan. 25, 2012.

(60) Provisional application No. 61/461,996, filed on Jan. 26, 2011.

(51) Int. Cl.
*B65D 5/72* (2006.01)
*B31B 1/78* (2006.01)
(Continued)

(52) U.S. Cl.
CPC ... *B65D 5/72* (2013.01); *B31B 1/78* (2013.01); *B65D 5/563* (2013.01); *B65D 5/746* (2013.01)

(58) Field of Classification Search
USPC ..... 229/125.04, 125.01, 125.14, 131.1, 229/125.42, 214; 493/184, 87; 53/133.2
See application file for complete search history.

(56) References Cited

U.S. PATENT DOCUMENTS 1,772,625 A 8/1930 Caulfield
2,192,722 A 3/1940 Vogt
(Continued)

FOREIGN PATENT DOCUMENTS

DE 29 23 455 A1 12/1980
DE 81 10 323.9 9/1981
(Continued)

OTHER PUBLICATIONS

International Search Report for corresponding International Application No. PCT/US2012/022458 mailed Aug. 7, 2012.
(Continued)

*Primary Examiner* — Christopher Demeree
(74) *Attorney, Agent, or Firm* — Womble Carlyle Sandridge & Rice, LLP

(57) ABSTRACT

A carton includes a chamfered corner, and a dispenser defined in the chamfered corner. A fitment may be mounted to the chamfered corner of the carton, for use in dispensing contents from the interior of the carton by way of the dispenser. The fitment may comprise a base with a rearward receptacle that is in receipt of the chamfered corner of the carton. A passageway extends through the base, from the receptacle to a front opening of the passageway, and the contents from the interior of the carton may be dispensed outwardly through the front opening of the fitment. The fitment may include one or more inwardly protruding mounting members that may engage behind one or more edges of the carton for restricting the fitment from being pulled off of the chamfered corner of the carton.

23 Claims, 14 Drawing Sheets

(51) Int. Cl.
*B65D 5/56* (2006.01)
*B65D 5/74* (2006.01)

(56) References Cited

U.S. PATENT DOCUMENTS

| | | | | |
|---|---|---|---|---|
| 2,355,665 | A | | 8/1944 | Mabee |
| 2,475,677 | A | | 7/1949 | Ringler |
| 2,509,289 | A | | 5/1950 | Dunning |
| 3,105,591 | A | | 10/1963 | Ahlbor |
| 3,133,688 | A | | 5/1964 | Asman |
| 3,233,817 | A | * | 2/1966 | Casady ..... 229/117.3 |
| 3,302,847 | A | | 2/1967 | Hennessey |
| 3,347,446 | A | | 10/1967 | Reynolds et al. |
| 3,355,089 | A | | 11/1967 | Champlin |
| 3,363,822 | A | | 1/1968 | Maulini et al. |
| 3,426,955 | A | | 2/1969 | Olson |
| 3,426,956 | A | | 2/1969 | Frohlicher |
| 3,669,345 | A | | 6/1972 | Cote |
| 3,680,766 | A | | 8/1972 | Collura et al. |
| 3,690,544 | A | | 9/1972 | Meyers |
| 3,768,719 | A | | 10/1973 | Johnson |
| 3,982,683 | A | | 9/1976 | Forteau |
| 4,344,537 | A | | 8/1982 | Austin |
| 4,508,218 | A | | 4/1985 | Focke |
| 4,558,785 | A | | 12/1985 | Gordon |
| 4,572,422 | A | * | 2/1986 | Heuberger et al. ..... 229/117.3 |
| 4,645,108 | A | | 2/1987 | Gavin |
| 4,676,394 | A | | 6/1987 | Hiersteiner |
| 4,768,703 | A | | 9/1988 | Sosler |
| 4,771,936 | A | | 9/1988 | Dolby |
| 4,905,898 | A | | 3/1990 | Wade |
| 5,125,566 | A | * | 6/1992 | Deiger ..... 229/125.15 |
| 5,201,462 | A | | 4/1993 | Sada et al. |
| 5,292,058 | A | | 3/1994 | Zoss |
| 5,347,865 | A | | 9/1994 | Mulry |
| 5,402,933 | A | | 4/1995 | Behrmann |
| 5,632,402 | A | | 5/1997 | Walsh |
| 5,632,404 | A | | 5/1997 | Walsh |
| 5,746,871 | A | | 5/1998 | Walsh |
| 5,783,030 | A | | 7/1998 | Walsh |
| 5,794,811 | A | | 8/1998 | Walsh |
| 5,794,812 | A | | 8/1998 | Walsh |
| 5,857,614 | A | | 1/1999 | Walsh |
| 5,911,359 | A | | 6/1999 | Stone |
| 5,918,799 | A | | 7/1999 | Walsh |
| 6,050,484 | A | | 4/2000 | Galomb |
| 6,062,467 | A | | 5/2000 | Ours |
| 6,102,277 | A | | 8/2000 | Krapohl, Sr. |
| 6,145,736 | A | | 11/2000 | Ours |
| 6,206,279 | B1 | | 3/2001 | Countee |
| 6,352,096 | B1 | | 3/2002 | Walsh |
| 6,364,202 | B1 | | 4/2002 | Zelley |
| 6,386,438 | B1 | | 5/2002 | Walsh |
| 6,419,151 | B1 | | 7/2002 | Urtubey |
| 6,688,515 | B1 | | 2/2004 | Huffman et al. |
| 6,854,639 | B2 | | 2/2005 | Walsh |
| 6,869,009 | B2 | | 3/2005 | Sutherland |
| 6,913,190 | B2 | | 7/2005 | Ruhbusch |
| 7,025,504 | B2 | | 4/2006 | Olin |
| 7,036,714 | B2 | | 5/2006 | Walsh |
| 7,210,612 | B2 | | 5/2007 | Walsh |
| 7,306,135 | B2 | | 12/2007 | DeBusk |
| 7,407,087 | B2 | | 8/2008 | DeBusk |
| 7,503,475 | B2 | | 3/2009 | McGowan |
| D597,835 | S | | 8/2009 | Kwon et al. |
| 7,703,665 | B2 | | 4/2010 | McGowan |
| 7,913,897 | B2 | | 3/2011 | Manaige |
| 7,959,060 | B2 | | 6/2011 | Wilson |
| 8,002,171 | B2 | | 8/2011 | Ryan |
| 8,061,585 | B2 | | 11/2011 | Nikolai |
| 2001/0048022 | A1 | | 12/2001 | Zoeckler |
| 2002/0055429 | A1 | | 5/2002 | Walsh |
| 2003/0144121 | A1 | | 7/2003 | Walsh |
| 2004/0226989 | A1 | | 11/2004 | Cook |
| 2005/0127150 | A1 | | 6/2005 | Walsh |
| 2005/0187087 | A1 | | 8/2005 | Walsh |
| 2005/0211754 | A1 | | 9/2005 | Fulcher |
| 2005/0274782 | A1 | | 12/2005 | Petrelli |
| 2006/0054675 | A1 | | 3/2006 | Bennett |
| 2006/0243783 | A1 | | 11/2006 | Spivey |
| 2007/0235511 | A1 | | 10/2007 | Fitzwater |
| 2009/0045084 | A1 | | 2/2009 | Rolla et al. |
| 2010/0193575 | A1 | | 8/2010 | Fontaine |

FOREIGN PATENT DOCUMENTS

| | | | |
|---|---|---|---|
| DE | 87 08 078.8 | | 10/1987 |
| DE | 94 13 813 | U1 | 10/1994 |
| EP | 0 406 556 | A1 | 1/1999 |
| EP | 1 386 846 | A1 | 2/2004 |
| EP | 1 457 425 | A1 | 9/2004 |
| FR | 2 699 150 | | 6/1994 |
| FR | 2 755 670 | | 5/1998 |
| GB | 104445 | | 3/1917 |
| GB | 1 242 356 | | 8/1971 |
| GB | 1 489 963 | | 10/1977 |
| GB | 1 584 066 | | 2/1981 |
| GB | 2 363 372 | A | 12/2001 |
| JP | 05-310266 | | 11/1963 |
| JP | 50-123654 | | 10/1975 |
| WO | WO 95/28325 | | 10/1995 |
| WO | WO 2006/124643 | A1 | 11/2006 |
| WO | WO 2006/133401 | A2 | 12/2006 |

OTHER PUBLICATIONS

Written Opinion of the International Searching Authority for corresponnding International Application No. PCT/US2012/022458 mailed Aug. 7, 2012.

International Search Report and Written Opinion for PCT/US2011/061148 dated May 7, 2012.

* cited by examiner

CARTON WITH RECLOSABLE FITMENT

CROSS-REFERENCE TO RELATED APPLICATIONS

This application is a continuation application of PCT Application No. PCT/US2012/022458, filed Jan. 25, 2012, which PCT application claims the benefit of U.S. Provisional Application No. 61/461,996, filed Jan. 26, 2011. The entire disclosures of PCT Application No. PCT/US2012/022458 and U.S. Provisional Application No. 61/461,996 are incorporated herein by reference for all purposes as if set forth herein in their entireties.

BACKGROUND

The present disclosure generally relates to a carton for containing and dispensing contents, such a carton that may have a reclosable fitment, and a reclosable fitment for a carton.

SUMMARY

One aspect of this disclosure is the provision of a carton for containing and dispensing contents, and a fitment may optionally be mounted to an outer chamfered corner of the carton for being opened and closed to respectively provide and restrict access to the contents of the carton. The fitment may be molded of polymer material.

In one aspect of this disclosure, the carton comprises a plurality of panels respectively foldably connected to one another, and the plurality of panels extends around an interior of the carton. The plurality of panels may include opposite first and second major side panels, opposite first and second minor side panels that are each smaller than the first and second major side panels, a bottom panel at least partially closing a bottom end of the carton, a top panel at least partially closing a top end of the carton, and an oblique panel at least partially defining the chamfered corner of the carton. The oblique panel may extend between the first and second major side panels, the oblique panel may extend between the top panel and the first minor side panel, and the oblique panel may extend obliquely relative to each of the first and second major side panels, the first and second minor side panels, and the top and bottom panels. A dispenser (e.g., a hole) may be defined in the chamfered corner (e.g., in the oblique panel), for use in dispensing contents from the interior of the carton. When the carton is in combination with the fitment, the fitment may be mounted to the chamfered corner of the carton so that the fitment is for use in dispensing contents from the interior of the carton by way of the dispenser.

The carton may be erected from a blank in which a respective one of the minor panels has first and second edges that are opposite from one another, and third and fourth edges that are opposite from one another, wherein the third and fourth edges extend crosswise to the first and second edges. The oblique panel of the carton may be referred as a dispenser panel in the blank, and the dispenser panel is connected to the third edge of the respective minor panel by a fold line. The first and second major panels are respectively foldably connected to the first and second edges of the respective minor panel. Each of the first and second major side panels comprises an oblique edge, wherein the oblique edges extend outwardly from proximate respective ends of the fold line, and the oblique edges extending divergently with respect to one another in an outward direction away from the fold line. The dispenser panel is positioned between the oblique edges.

The carton may be partially erected from the blank, so that the opposite first and second major side panels are substantially parallel to one another and respectively extend from opposite edges of the minor side panels. The dispenser panel may be folded inwardly relative to the respective minor side panel, toward the oblique edges of the major side panels, so that the dispenser panel extends obliquely and at least partially defines the chamfered corner of the carton. As examples, the dispenser panel may be attached to outer surfaces of the major side panels by way of mounting flaps or mounting pleats foldably connected to the opposite edges of the dispenser panel, or in any other suitable manner.

According to one aspect of this disclosure, a base of the fitment may comprise a plurality of walls defining a rearwardly open receptacle for receiving the chamfered corner of the carton. The plurality of walls may extend around a passageway, and the passageway may extend through the base from the receptacle to a front opening of the passageway. A lid for opening and closing the front opening to the passageway may be removably connected to the base by a connector, such as a flexible hinge.

The fitment may be mounted to the chamfered corner of the carton, such as by causing relative movement between the carton and the fitment so that the chamfered corner is received in the rearward receptacle of the fitment. The fitment may optionally include one or more inwardly protruding mounting members that may engage in one or more holes and/or behind one or more edges of the carton. More specifically, the mounting member(s) may engage behind one or more panels (e.g., the mounting flaps or mounting pleats) of the carton for restricting the fitment from being pulled off of the chamfered corner of the carton.

The foregoing presents a simplified summary of some aspects of this disclosure in order to provide a basic understanding. The foregoing summary is not extensive and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which illustrate exemplary embodiments of this disclosure, are not necessarily drawn to scale and may be schematic, and wherein.

DETAILED DESCRIPTION OF EXEMPLARY EMBODIMENTS

Referring now in greater detail to the drawings, in which like numerals may refer to like parts throughout the several views, exemplary embodiments are described in the following.

Figure 1:
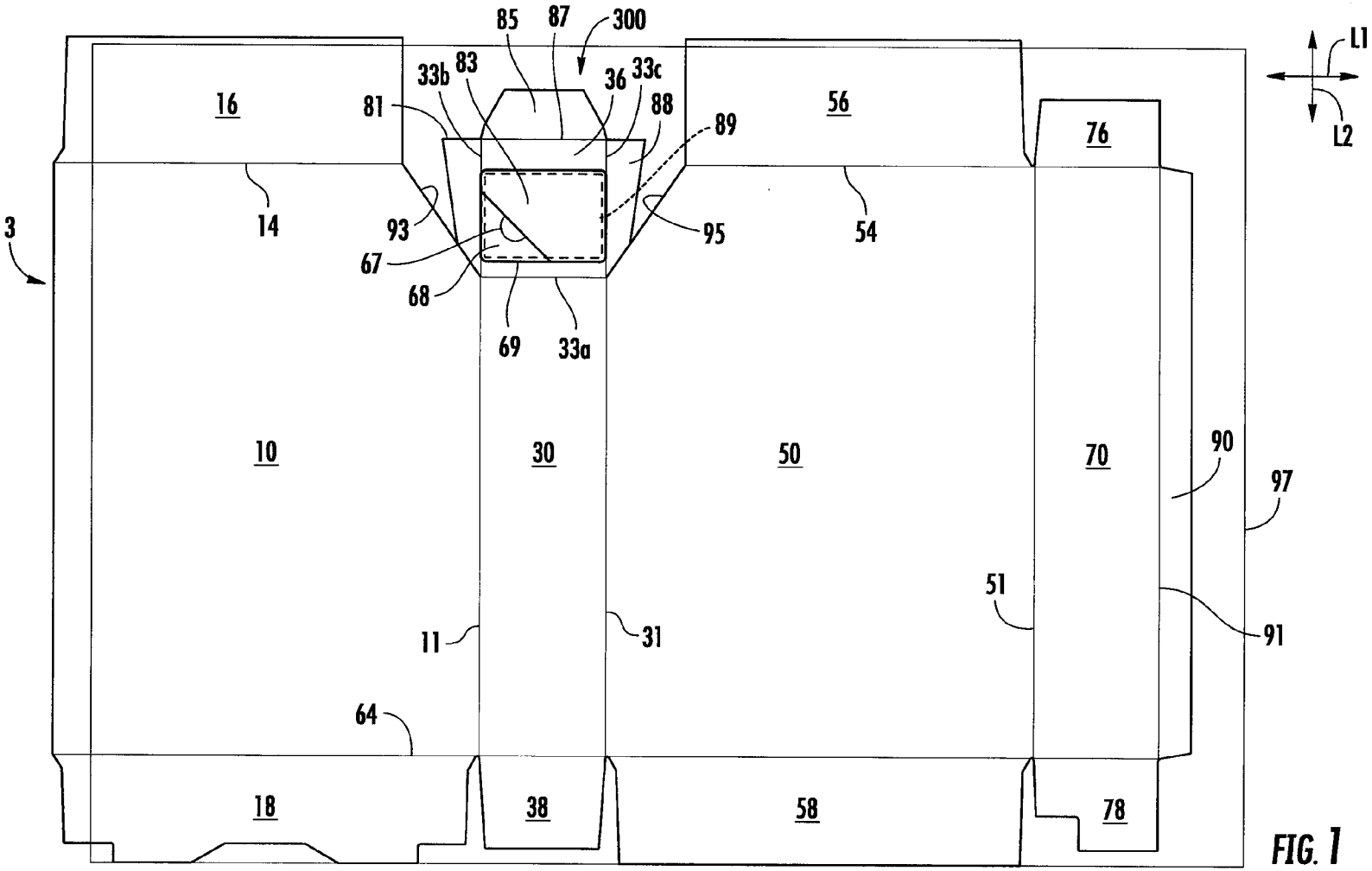
FIG. 1 is a plan view of a blank with a liner mounted thereto, in accordance with a first embodiment of this disclosure.

FIG. 1 is a plan view of an interior side of a blank 3 that is for being erected into a carton 5 (FIG. 2) that is for having a openable and reclosable fitment 200 (FIGS. 3A-4) mounted thereto, in accordance with a first embodiment of this disclosure. As shown in FIG. 1, an expansive sheet of polymer film (e.g., polyethylene), or the like, which may be referred to as a liner 97, is adhered to and covering a substantial portion of the interior side of the blank 3. In FIG. 1, the liner 97 is illustrated as being clear, so that the blank 3 is seen through the liner 97. The liner 97 is for lining (e.g., forming a bag within) the interior of the carton 5 erected from the blank 3, so that the liner may enhance the barrier protection provided by the carton, as will be discussed in greater detail below. The liner 97 is optional and may be omitted, and a variety of different liners are within the scope of this disclosure.

The blank 3 has a longitudinal axis L1 and a lateral axis L2. The blank 3 has a first major side panel 10 foldably connected to a first minor side panel 30 at a first lateral fold line 11, a second major side panel 50 foldably connected to the first minor side panel 30 at a second lateral fold line 31, and a second minor side panel 70 foldably connected to the second major side panel 50 at a third lateral fold line 51. An attachment flap 90 is foldably connected to the second minor side panel 70 at a fourth lateral fold line 91, although the attachment flap may be foldably attached to the first major side panel 10, or at any other suitable location.

The first major side panel 10 is foldably connected to a top flap 16 and a bottom flap 18. The first minor side panel 30 is foldably connected to a mount assembly 300 and a bottom flap 38. The second major side panel 50 is foldably connected to a top flap 56 and a bottom flap 58. The second minor side panel 70 is foldably connected to a top flap 76 and a bottom flap 78. The top flaps 16, 56, 76 extend along a first or top marginal area of the blank 3. Top flap 16 is foldably connected to first major side panel 10 at a first longitudinally extending fold line 14. The mount assembly 300 is foldably connected to first minor side panel 30 at a second longitudinally extending fold line 33*a*. Top flap 56 is foldably connected to second major side panel 50, and top end flap 76 is foldably connected to second minor side panel 70, at a third longitudinally extending fold line 54. The bottom flaps 18, 38, 58, 78 extend along a second or bottom marginal area of the blank 3, and may be foldably connected along a fourth longitudinally extending fold line 64.

The first, second, third and fourth longitudinal fold lines 14, 33*a*, 54, 64 may be, for example, generally straight lines of disruption. Alternatively, the fold lines 14, 33*a*, 54, 64 may be offset at one or more locations to account for, for example, blank thickness or other factors. When the carton 5 (FIG. 2) is erected and closed, the top flaps 16, 56, 76 at least partially close a top of the carton 5, and the bottom flaps 18, 38, 58, 78 at least partially close a bottom of the carton 5, as will be discussed in greater detail below.

The first major side panel 10 has an oblique edge 93 and the second major side panel 50 has an oblique edge 95. The oblique edge 93 extends between the fold lines 14, 33*a*. The oblique edge 95 extends between the fold lines 33*a*, 54. The upper regions of the oblique edges 93, 95 are immediately adjacent wide holes through the blank 3, whereas the lower regions of the oblique edges 93, 95 are merely separated from the mount assembly 300 by respective slits or other suitable cuts.

As will be discussed in greater detail below, when the blank 3 is erected into the carton 5 (FIG. 2), the mount assembly 300 forms a mount/obliquely configured, upper corner (e.g., a chamfered corner) of the carton to which the reclosable fitment 200 (FIGS. 3A-4) may be mounted. The mount assembly 300 has a central access or dispenser panel 36, side mounting flaps 81, 88 and a top mounting flap 85 that are respectively foldably connected to the dispenser panel 36 at fold lines 33*b*, 33*c*, 87. The side and top mounting flaps 81, 85, 88 may be characterized as being wings, or wing-like flaps. The dispenser panel 36 has a substantially rectangular dispenser opening 83 that extends through the dispenser panel. The dispenser opening 83 may be formed, for example, by die cutting, and removing at least a portion of the resulting cut out portion of the blank 3 from the reminder of the blank. The dispenser opening 83 may be formed in any other suitable manner and may define a variety of different shapes. As one alternative example, the dispenser opening 83 may be defined by a tear line or other suitable line(s) of disruption that defines both the periphery of the dispenser opening 83 and a periphery of a tear-away portion of the blank that is torn away to open the dispenser opening 83.

Referring to FIG. 1, the first minor side panel 30 has first and second edges that are opposite from one another, and third and fourth edges that are opposite from one another, wherein the third and fourth edges extend crosswise to the first and second edges. The dispenser panel 36 is connected to the third edge of the first minor side panel 30 by the second longitudinally extending fold line 33*a*. The major side panels 10, 50 are respectively foldably connected to the first and second edges of the first minor side panel 30 by the first and second lateral fold lines 11, 31. Each of the major side panels 10, 50 is larger than each of the minor side panels 30, 70. The oblique edges 93, 95 of the major side panels 10, 50 extend outwardly from proximate respective ends of the second longitudinally extending fold line 33*a*, and the oblique edges 93, 95 extend divergently with respect to one another in an outward direction away from the second longitudinally extending fold line 33*a*. The dispenser panel 36 is positioned between the oblique edges 93, 95.

In accordance with the first embodiment, when the liner 97 is included, it may be laminated or otherwise attached to the mount assembly 300, such as by way of adhesive material that is in close proximity to, and circumscribes, the dispenser opening 83, so that the dispenser opening 83 is fully closed by the liner 97. As will be discussed in greater detail below, after the carton 5 (FIG. 2) is erected from the blank 3, one acceptable method of obtaining access to the contents within the carton 5 includes manually tearing the portion of the liner 97 that covers the dispenser opening 83 so as to open the dispenser opening. The portion of the liner 97 that covers the dispenser opening 83 may serve as a "tamper evident seal".

Optionally, the liner 97 and/or blank 3 includes feature(s) that seek to aid in the manual opening of the dispenser opening 83. For example, the liner 97 may include a line of weakening 89 (e.g., tear line) that is proximate to and shaped substantially similarly to the periphery of the dispenser opening 83. The line of weakening 89 may be in the form of kiss cut(s) and/or a series of perforations (e.g., micro-perforations) that typically do not extend through the entire thickness of the liner 97, so that the line of weakening does not (e.g., substantially does not) define open passageways that extend through the entire thickness of the liner 97. Accordingly and in accordance with the first embodiment, prior to tearing along the line of weakening 89, the line of weakening 89 does not (substantially does not) degrade the barrier function provided by the liner 97. The line of weakening 89 may be formed by laser scoring, die cutting, heat stamping, or any other suitable method.

In accordance with the first embodiment, in addition to the dispenser opening 83 being closed by the predetermined portion of the liner 97 that extends across the dispenser opening 83, at least some of the portion of the liner 97 that that extends across the dispenser opening 83 may optionally have a reinforcement 68 mounted thereto. For example, the reinforcement 68 may be a portion of the blank 3 that is not removed from the dispenser opening 83 when the dispenser opening is formed. More specifically and in accordance with the first embodiment, the reinforcement 68 is a central portion of the dispenser panel 36. In this regard, the reinforcement 68 may be connected to and/or separated from a remaining portion of the dispenser panel 36 by a disruption, or more particularly a line of disruption 69, such as a tear line and/or a slit. As shown in FIG. 1, the line of disruption 69 has a first leg that extends along the longitudinal axis L1, and a second leg that extends from an end of the first leg along the lateral axis L2. As also shown in FIG. 1, an oblique edge of the reinforcement 68 extends between the opposite ends of the legs, and an arcuate line of disruption 67 (e.g., a tear line and/or slit) may have opposite ends that extend to the oblique edge, such as for defining a finger hold, or the like, that may be punched, stripped or struck from the reinforcement. The reinforcement 68 may be laminated and/or attached by adhesive material, or attached in any other suitable manner, to the portion of the liner 97 that extends across the dispenser opening 83.

Figure 2:
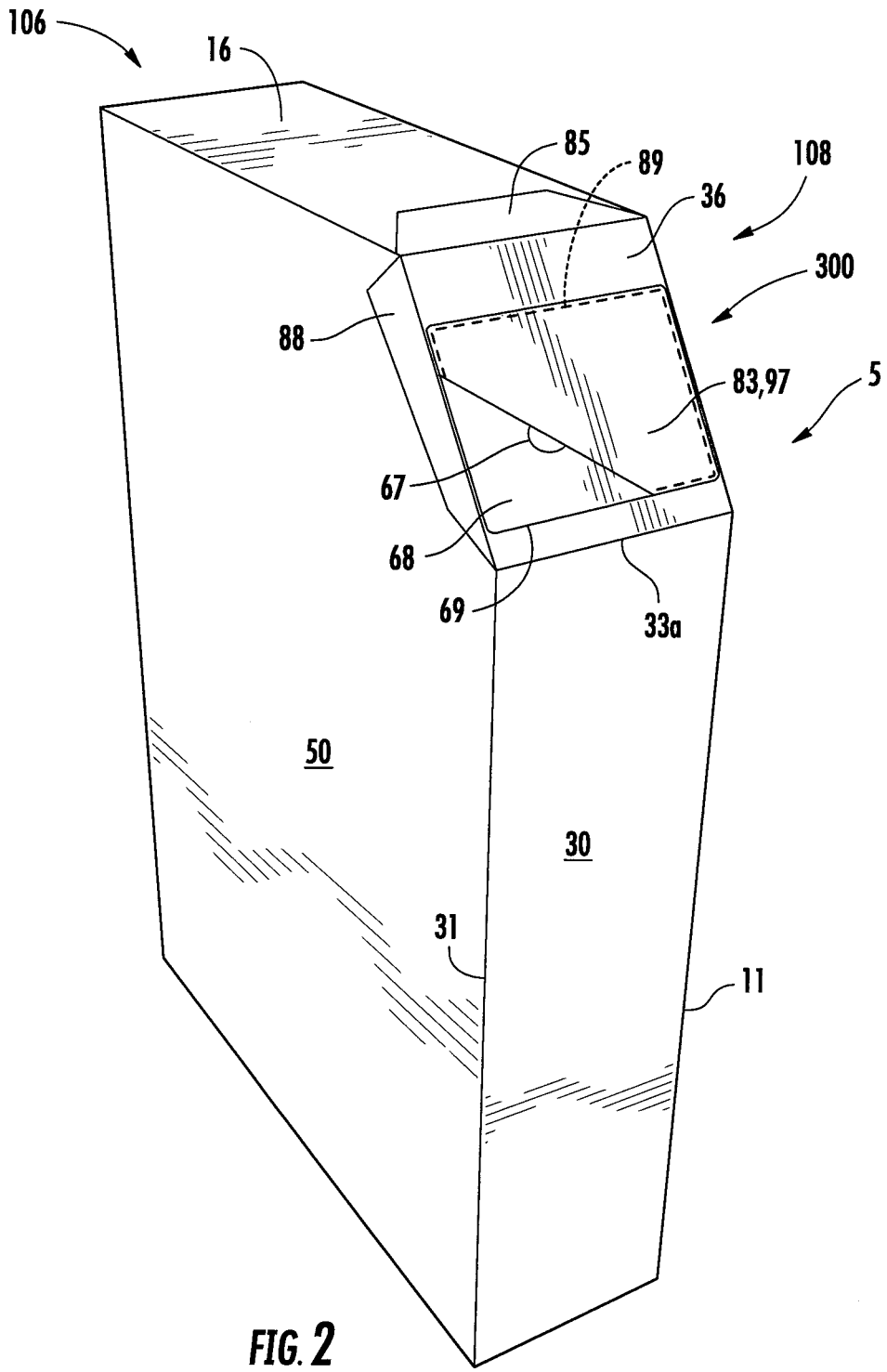
FIG. 2 is a perspective view of a carton erected from the blank of FIG. 1, in accordance with the first embodiment.

In FIGS. 1 and 2, the reinforcement 68 obstructs only a portion of the dispenser opening 83 so that the line of disruption 69 is part of a disruption that circumscribes the reinforcement. Whereas the reinforcement 68 is shown as obstructing only a portion of the dispenser opening 83 in FIGS. 1 and 2, the reinforcement may be omitted or the reinforcement may obstruct any other suitable amount of the dispenser opening, such as the entirety of the dispenser opening, such that the line of disruption 69 circumscribes the reinforcement 68.

As mentioned previously, the liner 97 may be omitted. As another alternative, only a portion of the liner 97 may be included, such as that portion that is mounted to and associated with the mount assembly 300, and that portion of the liner may be referred to as a patch. Those of ordinary skill in the art will understand that it is well known to mount a liner and/or patch to a carton blank. Accordingly, the liner 97 may be constructed of any suitable material, and may be mounted to the blank 3 in any suitable manner. For example, the liner 97 or patch may be mounted to the blank 3 through the use of a "window machine" (e.g., a machine for mounting patches, windows (e.g., clear polymer films), or the like, to carton blanks). This mounting may be carried out through laminating, the use of adhesive material and/or in any other suitable manner.

When the liner 97 is included, the fixed connections (e.g., adhesive material) between the blank 3 and the liner 97 are typically arranged in a manner that allows the blank 3 to be erected into the carton 5 (FIG. 4) and the liner 97 to be formed into a bag while the liner and the blank remain connected to one another. For example, typically there are no (e.g., substantially no) fixed connections/adhesive material between at least the marginal areas of the liner 97 and the blank 3, so that the liner 97 does not unduly interfere with the erection of the carton 5 and neither the blank 3 nor the carton 5 unduly interferes with the forming of the liner 97 into the bag that is ultimately within the interior of the carton. Alternatively, the bag may be mounted into the carton 5 after it is at least partially erected.

One example of a method of forming the carton 5 (FIG. 2), with the bag therein, from the blank 3 and liner 97 is described in the following, in accordance with the first embodiment. At least the liner 97 is folded along the lateral axis L2, and the opposite edges of the liner 97 that extend along the lateral axis L2 are joined to one another to form a suitable seal, such as a pinch seal, fin seal, foldover seal and/or any other suitable seal, so that the liner is in the form of a tube with unsealed opposite ends. Then, the upper end of the tubular liner 97 (i.e., the end adjacent the mount assembly 300) may be sealed closed with a pinch seal, fin seal, foldover seal and/or any other suitable seal. The blank 3 may, for example, be folded about the transverse lines of disruption 31, 91 so that the exterior side of the attachment flap 90 contacts the interior side of the first major side panel 10. The first major side panel 10 can be attached to the attachment flap 90 by, for example, adhesive material and/or any other suitable mechanism. In this configuration, the plurality of panels 10, 30, 50, 70 extends around an interior of the carton 5. The blank 3 may then be opened to have a generally tubular shape by folding about fold lines 11, 31, 51, 91.

The top of the carton 5 may be closed by inwardly folding the top flap 76, and then inwardly folding the top flaps 16, 56, so that these top flaps at least partially overlap one another. Adhesive material, or any other suitable fastening mechanism, may be applied to secure the top flaps 16, 56, 76 in their closed configuration. As at least partially shown in FIG. 2, the top flaps 16, 56, 76 close a rear portion 106 of the top of the carton 5. One or more of the inwardly folded top flaps 16, 56, 76 may be characterized as forming a top panel or top end panel of the carton 5, and the top end panel of the carton may be constructed in any suitable manner. The top end panel closes the top end of the carton 5, or more generally the top end panel at least partially closes the top end of the carton. That is, even if the top end panel does not fully close the top end of the carton 5, the liner 97, when present, may fully enclose the contents of the carton.

The mount assembly 300 is erected to close a front portion 108 of the top of the carton 5. The mount assembly 300 is folded inwardly about fold line 33*a* so that the dispenser panel 36 abuts each of the oblique edges 93, 95 of the first and second major side panels 10, 50, and the front edges of the top flaps 16, 56 (e.g., the front edge of the top end panel of the carton 5). In this configuration, the dispenser panel 36 extends obliquely (e.g., the dispenser panel is an oblique panel) and the dispenser panel at least partially defines the chamfered corner of the carton 5. The dispenser panel 36 is typically connected to one or more of the major side panels 10, 50 and the top end panel of the carton 5 to retain the dispenser panel in its oblique configuration. More specifically, the mount assembly 300 is further erected by folding the mounting flaps 81, 85, 88 inwardly relative to the dispenser panel 36. As partially shown in FIG. 2 and also referring to FIG. 1, the side mounting flaps 81, 88 extend downwardly below the oblique edges 93, 95, and the top mounting flap 85 extends rearwardly along the top flaps 16, 56 when the mount assembly 300 is fully erected and closing the upper front portion 108 of the carton 5. The inwardly facing surfaces of the mounting flaps 81, 85, 88 are typically fixedly connected to the outwardly facing surfaces of the first and second major side panels 10, 50 and the outermost one of the top flaps 16, 56 with adhesive material or any other suitable mechanism. In accordance with the first embodiment, the erected mount assembly 300 defines an oblique, upper, chamfered corner of the carton 5, although differently configured mount assemblies and/or upper corners of the carton are within the scope of this disclosure. The dispenser panel 36, mounting flaps 81, 85, 88, oblique edges 93, 95, forward edges of the top flaps 16, 56; and adjacent portions of the top flaps, major side panels 10, 50 and first minor side panel 30 may be characterized as defining the chamfered corner of the carton 5, although the chamfered corner may be configured differently. For example, one or more of the mounting flaps 81, 85, 88 may be configured differently, such as by being hingedly connected to a different panel and/or by being in the form of a pleat, or the like, as will be discussed in greater detail below.

At this point in the assembly process, both the lower end of the carton 5 and the lower end of the bag formed from the liner 97 are open. Product(s) such as food products (not shown) or any other suitable contents may be placed into the bag formed from the liner 97 by way of its open end. Then, the open end of the bag formed from the liner 97 may be sealed closed, such as by forming a pinch seal, fin seal, foldover seal and/or any other suitable seal in that end of the bag. The seals by which the liner 97 is formed into the bag/closed bag may be formed in any suitable manner. For example, the seals may be formed through the use of adhesive material (e.g., glue and/or a hot melt or sonically activatable adhesive material).

The bottom of the carton 5 can be closed by folding the bottom flaps 38, 78 inwardly, followed by folding the bottom flaps 18, 58 inwardly, so that the bottom flaps at least partially overlap one another. Adhesive material, or any other suitable fastening mechanism, may be applied to secure the bottom flaps 18, 38, 58, 78 in their closed configuration. One or more of the inwardly folded bottom flaps 18, 38, 58, 78 may be characterized as forming a bottom panel or bottom end panel of the carton 5, and the bottom end panel of the carton may be constructed in any suitable manner. The bottom end panel closes the bottom end of the carton 5, or more generally the bottom end panel at least partially closes the bottom end of the carton. That is, even if the bottom end panel does not fully close the bottom end of the carton 5, the liner 97, when present, may fully enclose the contents of the carton. Alternatively, the bottom end of the liner 97 and carton 5 may be closed first, following by filling the bag formed from the liner at its open upper end, and then closing the upper end of the bag and the carton.

Figure 3A:
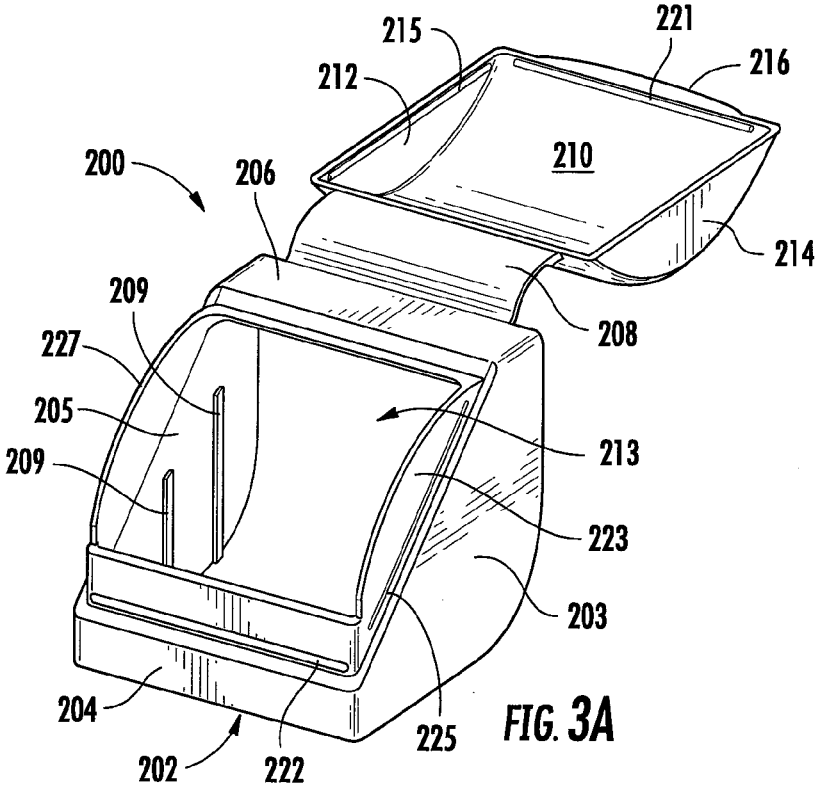
FIG. 3A is a top perspective view of fitment for being mounted to the carton of FIG. 2, wherein the fitment is in an open configuration, in accordance with the first embodiment.

FIGS. 3A-3E illustrate the opened, reclosable fitment 200 that is for being mounted to the erected mount assembly 300 of the carton 5 (FIG. 2). In accordance with the first embodiment, the fitment 200 is molded from polymeric material (e.g., polypropylene) and all of the features of the fitment are formed integrally with one another, although the fitment may be formed in any suitable manner from any suitable material. Referring primarily to FIG. 3A, the fitment 200 includes a frame or base 202, a flexible hinge 208 and a lid 210. The base 202 is connected to the lid 210 by the hinge 208. The base 202 includes a lower front wall 204, an upper wall 206, an opening 213, and a pair of side walls 203, 205.

The base 202 of the fitment 200 may optionally include side flanges 223, 227 extending upwardly from oblique edges of the side walls 203, 205, respectively. The hinge 208 is flexible for allowing the lid 210 to be moved relative to the opening 213 between an open configuration, which is shown in FIGS. 3A-3E, and a closed configuration, in which the lid closes the opening. The lid 210 optionally includes a tab 216 located at an edge of the lid 210, and the tab may be manually grasped or used as a finger hold for aiding a user in opening and closing the lid. In accordance with the first embodiment, a majority of the fitment 200 has a wall thickness of about 0.05 inches, although any suitable thickness may be utilized.

The fitment 200 typically includes a releasable locking mechanism for releasably securing the lid 210 in the closed configuration. In accordance with the first embodiment, the locking mechanism defines a releasable interference fit/press fit/friction fit, or the like, between the base 202 and the lid 210. For example and as best understood with reference to FIGS. 3A-3B, the locking mechanism includes an elongate locking projection 222 that is integrally formed on and extends across the outer surface of a front surface of the lower front wall 204, elongate locking projections 225 that are integrally formed on and extend across the outer surfaces of the side flanges 223, 227, elongate locking projections 215 that are integrally formed on and extend across the inner surfaces of side walls 212, 214 of the lid 210, and an elongate locking projection 221 that is integrally formed on and extends across the inner surface of an arcuate top wall of the lid 210. The locking projections 222, 225 are respectively engageable with the locking projections 215, 221 when the lid 210 is closed. The lid 210 may be releasably locked in the closed position by applying downward pressure to the lid 210 until the locking projection 215, 221 are respectively snap-fitted over the locking projections 222, 225. The reclosable fitment 200 has a generally curvilinear domed shape but could be otherwise shaped, arranged, and/or configured without departing from the disclosure.

The plurality of walls 203, 204, 205, 206 of the base 202 define a rearwardly open mounting receptacle of the fitment 200, and the rearwardly open mounting receptacle is for receiving the chamfered corner of the carton 5. The walls 203, 204, 205, 206 extend around a passageway that extends through the base 202, and the passageway extends from the mounting receptacle to the front opening 213 of the passageway.

Figure 3B:
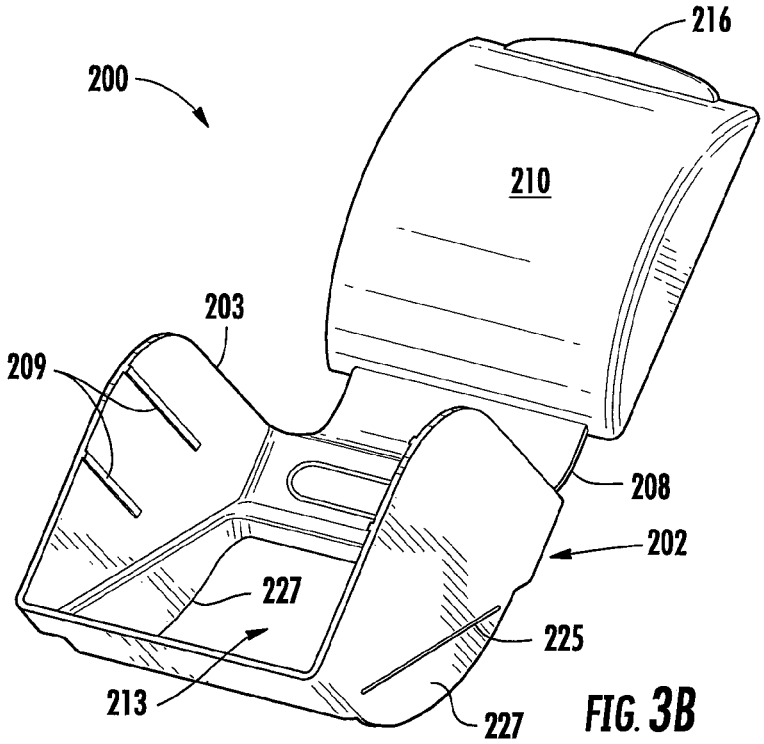
FIG. 3B is a bottom perspective view of the fitment of FIG. 3A in the open configuration.
Figure 3C:
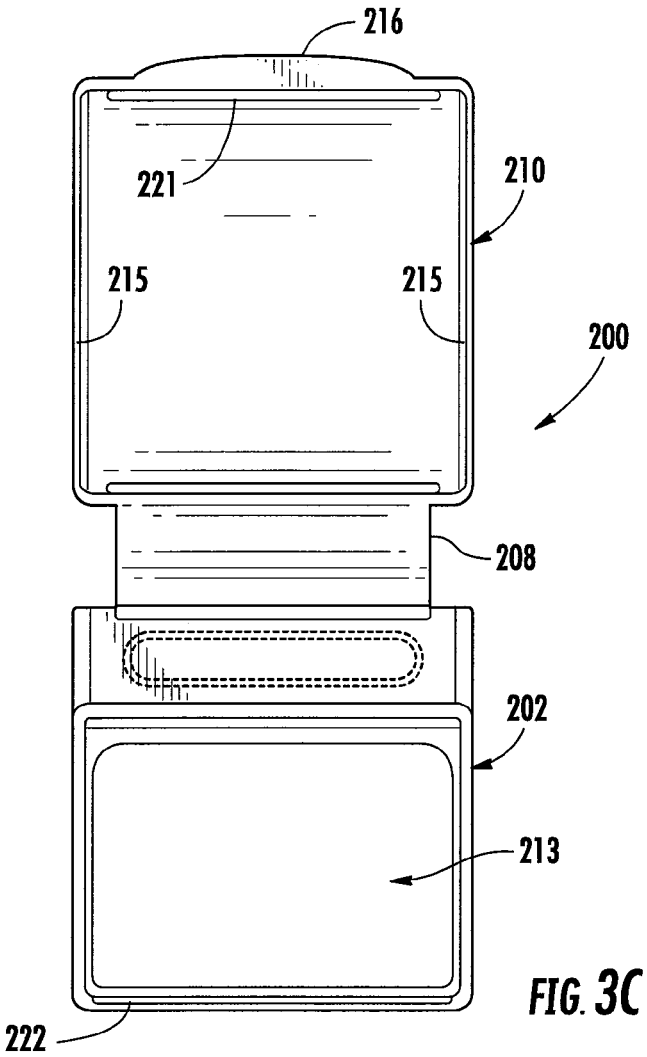
FIG. 3C is a top plan view of the fitment of FIG. 3A in the open configuration.
Figure 3D:
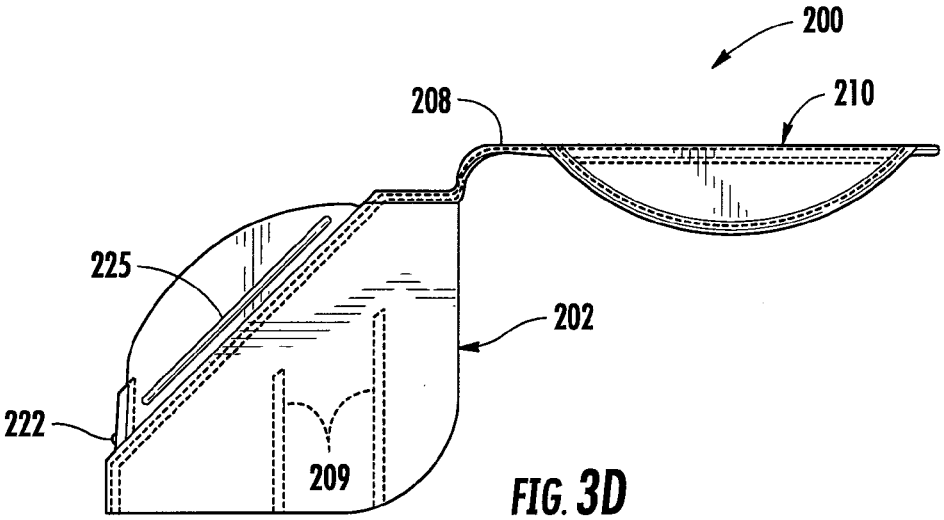
FIG. 3D is a right elevation view of the fitment of FIG. 3A in the open configuration, wherein a left elevation view of the fitment of FIG. 3A in the open configuration is a mirror image of FIG. 3D.
Figure 3E:
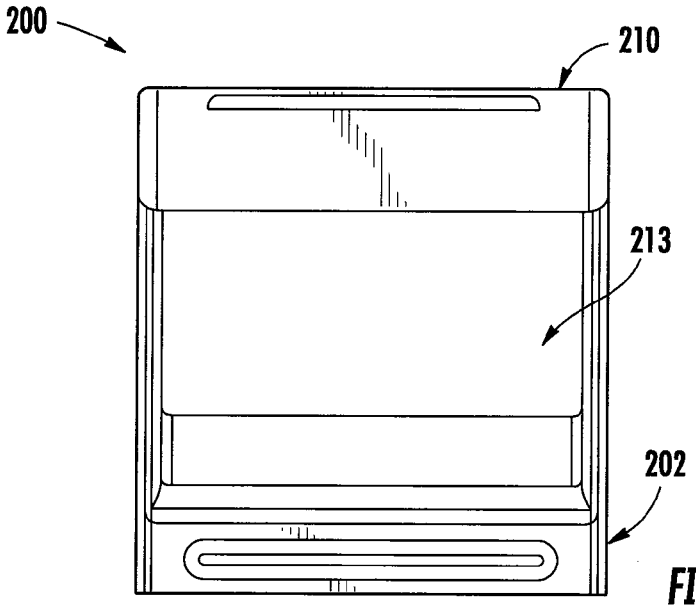
FIG. 3E is a rear elevation view of the fitment of FIG. 3A in the open configuration.
Figure 4:
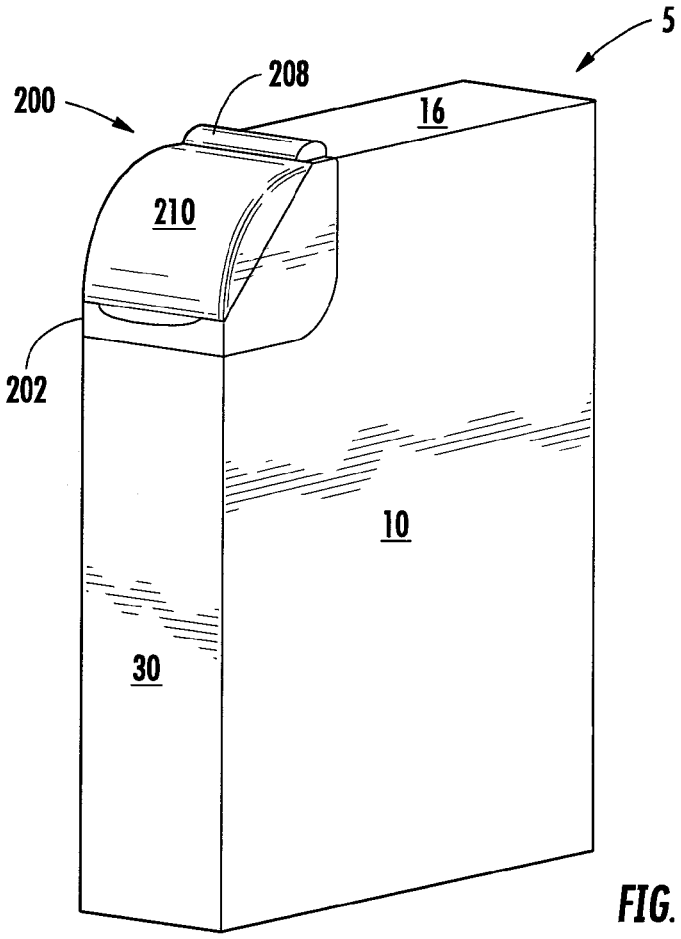
FIG. 4 is a perspective view of the fitment of FIGS. 3A-3E mounted to the carton of FIG. 2, wherein the fitment is in a closed configuration, in accordance with the first embodiment.

Referring also to FIG. 4, the interior surfaces each of the lower front wall 204, the upper wall 206 and the side walls 203, 205/side flanges 223, 227 of the base 202 are cooperatively configured for snuggly fitting over the erected mount assembly 300/obliquely configured, front, upper chamfered corner of the carton 5, such that there is at least somewhat (e.g., substantially) an interference fit/press fit/friction fit, or the like, therebetween. In addition, the base 202 of the fitment 200 may include mounting features that seek to aid in the mounting of the base of the fitment to the erected mount assembly 300/oblique chamfered corner of the carton 5. More specifically and referring primarily to FIGS. 3A-3D, the interior surfaces of each of the side walls 203, 205 of the base 202 may include a pair of spaced apart, elongate mounting protrusions 209 that extend away from the opening 213 of the fitment 200. The mounting protrusions are elongate in a direction extending from the front opening 213 to the rear end/mounting receptacle of the base 202.

The fitment 200 may be mounted to the chamfered corner of the carton 5 by way of relative movement between the carton and the fitment, such that the chamfered corner is received in the rearward mounting receptacle of the fitment. For example, when the rearward mounting receptacle of the base 202 of the fitment 200 is pushed onto the erected mount assembly 300/obliquely configured, front, upper, chamfered corner of the carton 5, the base continues to slide farther onto the chamfered corner defined by the mount assembly until the inner surfaces of both the lower and upper walls 204, 206 of the base 202 fully and snuggly abut the respective portions of the carton 5 in a manner that arrests the relative movement between the carton and the base of the fitment. At substantially the same time as the arresting, the ends of the mounting protrusions 209 that are closest to the opening 213 respectively move past and engage the edges of the mounting flaps 81, 88 that are farthest from the dispenser panel 36. The respective engagement between these ends of the mounting protrusions 209 and these edges of the mounting flaps 81, 88 restricts, or at least inhibits, the base 202 of the fitment 200 from being moved relative to (e.g., being pulled off of) the chamfered corner of the carton 5 such that the base of the fitment is substantially fixedly mounted onto the chamfered corner. For each pair of mounting protrusions 209 shown in FIGS. 3A and 3B, the mounting protrusions of the pair have different lengths that are coordinated with the configuration of the rear edges of the mounting flaps 81, 88 so the end of each of the mounting protrusions engages behind the edge of the respective mounting flap. One or more of the mounting protrusions 209 may be omitted and/or differently configured mounting protrusions may be utilized.

Alternatively or in addition, adhesive material may be positioned between the base 202 of the fitment 200 and the chamfered corner of the carton 5 for holding them together, and/or any other suitable fastening mechanisms may be used between the base and the chamfered corner of the carton 5. For example and in accordance with the first embodiment, adhesive material in combination with the interaction between the ends of the mounting protrusions 209 and the edges of the mounting flaps 81, 88 fixedly connects the base 202 of the fitment 200 to the chamfered corner of the carton 5. Alternatively, there may be any other suitable connection(s) between the base 202 of the fitment 200 and the chamfered corner of the carton 5, and these connection(s) may be releasable, such as if it is desired to reuse the fitment 200 or separate it from the carton for recycling purposes, or the like.

One example of a method of using carton 5 (FIG. 4) is described in the following, in accordance with the first embodiment. A user (e.g., consumer) may obtain the carton 5 with the base 202 of the fitment 200 fixedly mounted to the chamfered corner/erected mount assembly 300, and the lid 210 of the fitment 200 in its closed configuration (e.g., see FIG. 4), in which the lid is firmly, yet releasably, mounted to the of base 202 of the fitment by way of the above-described releasable locking mechanism, or the like.

When the user desires to access contents within the bag, which is formed by the liner 97 within the carton 5, the lid 210 of the fitment 200 may be manually opened relative to the base 202 of the fitment (e.g., see FIGS. 3A-3E), while the base remains fixedly mounted to the chamfered corner/erected mount assembly 300 (e.g., see FIG. 4). For example, the lid 210 of the fitment 200 may be opened by pulling upwardly on the tab 216 to respectively release the locking projections 211, 215, 222, 225 of the lid 210 and base 202 from one another. The hinge 208 of the fitment 200 may be biased to hold the lid 210 in its open position away from the base 202, so that the user has access to the carton's dispenser panel 36 by way of the fitment's opening 213.

Then, the portion of the liner 89 that obstructs the dispenser opening 83 may be removed from dispenser opening 83. More specifically and in accordance with the first embodiment, the user may open the dispenser opening 83 by inserting a finger through the portion of the liner 97 that extends across the dispenser opening 83 and is adjacent to the reinforcement 68, to initiate tearing along the line of weakening 89. Then, the user may arrange the inserted finger behind the reinforcement 68, and pull outwardly to complete the tearing along the line of weakening 89 to remove the reinforcement and the portion of the liner bound by the line of weakening from the dispenser opening 83.

With the fitment's opening 83 and the dispenser opening 213 both opened, contents of the bag within the carton 5 may be poured from the bag/carton 5 by way of the openings 83, 213. After some of the contents have been poured from the carton 5, the lid 210 of the fitment 200 can be returned to its closed configuration (FIG. 4), and the lid can be releasably retained in the closed configuration by the locking projections 211, 215, 222, 225 of the lid 210 and base 202, respectively, or the reclosable fitment 200 can have other latching features. The contents of the carton 5 may include, for example, dispensable foodstuffs, or nonfood products such as detergent, powders, etc.

The fitment 200 may be reopened and closed numerous times, for accessing the remainder of the contents of the carton 5. The reclosable fitment 200 can be opened, reclosed, and reopened by various other steps or methods other than those described herein. Further, the steps of opening, reclosing, and reopening the fitment described herein can be modified, changed, and/or omitted without departing from the disclosure.

Figure 5A:
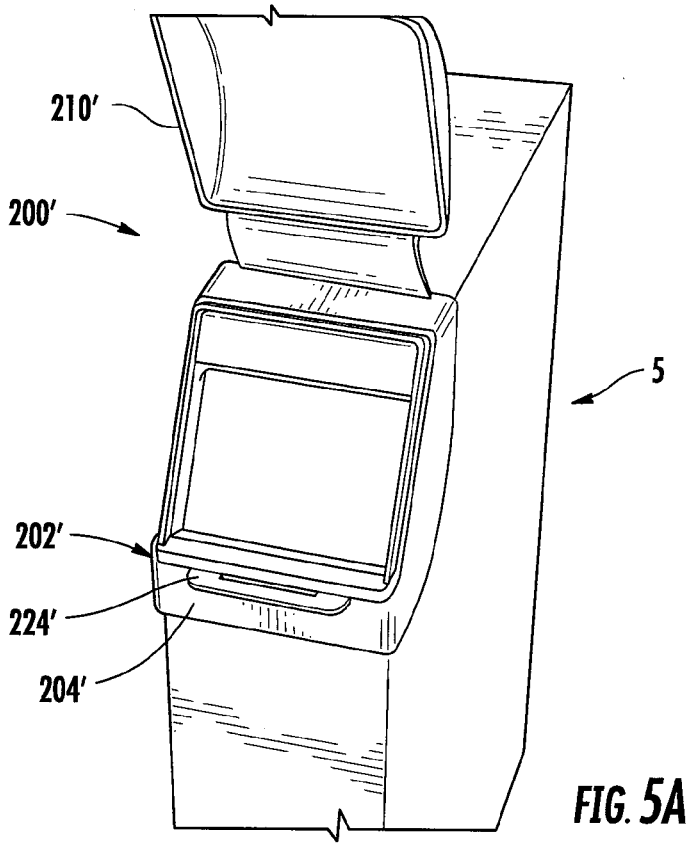
FIG. 5A is a perspective view of the carton of FIG. 2 with a fitment of a second embodiment mounted thereto, wherein the fitment is in an open configuration.
Figure 5B:
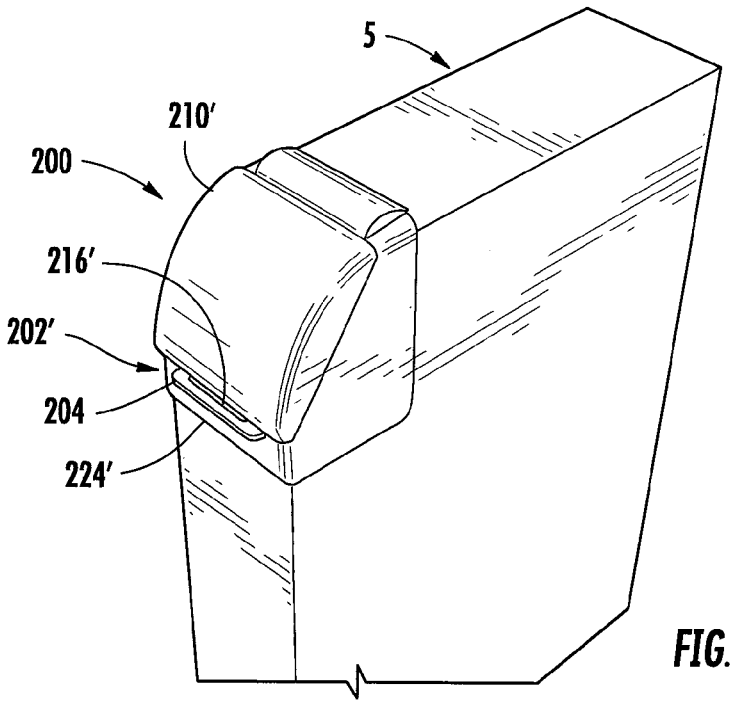
FIG. 5B is a perspective view of the carton and fitment of FIG. 5B, wherein the fitment is in a closed configuration, in accordance with the second embodiment of this disclosure.

FIGS. 5A and 5B illustrate the carton 5 with a fitment 200' of a second embodiment of this disclosure mounted thereto, with the fitment in its closed and open configurations, respectively. The second embodiment is like the first embodiment, except for variations noted and variations that will be apparent to those of ordinary skill in the art in view of this disclosure. For example, the fitment 200' of the second embodiment does not include the side flanges 223, 227 or releasable locking mechanisms (e.g., locking projections 211, 215, 222, 225) of the fitment 200 of the first embodiment. Rather, the releasable locking mechanism for releasably securing the lid 210' of the fitment 200' of the second embodiment in the closed configuration includes a catch member 224' that is integrally formed with and protrudes outwardly from the outer surface of the lower front wall 204' of the base 202' of the fitment 200'. The catch member 224' defines a central slot for releasably receiving the free edge of the tab 216' that protrudes from the lid 210'. Alternatively or in addition, the fitment 200 of the first embodiment may include the releasable locking mechanism of the fitment 200' of the second embodiment, and vice versa, and a variety of other releasable locking mechanisms are also within the scope of this disclosure.

Figure 6:
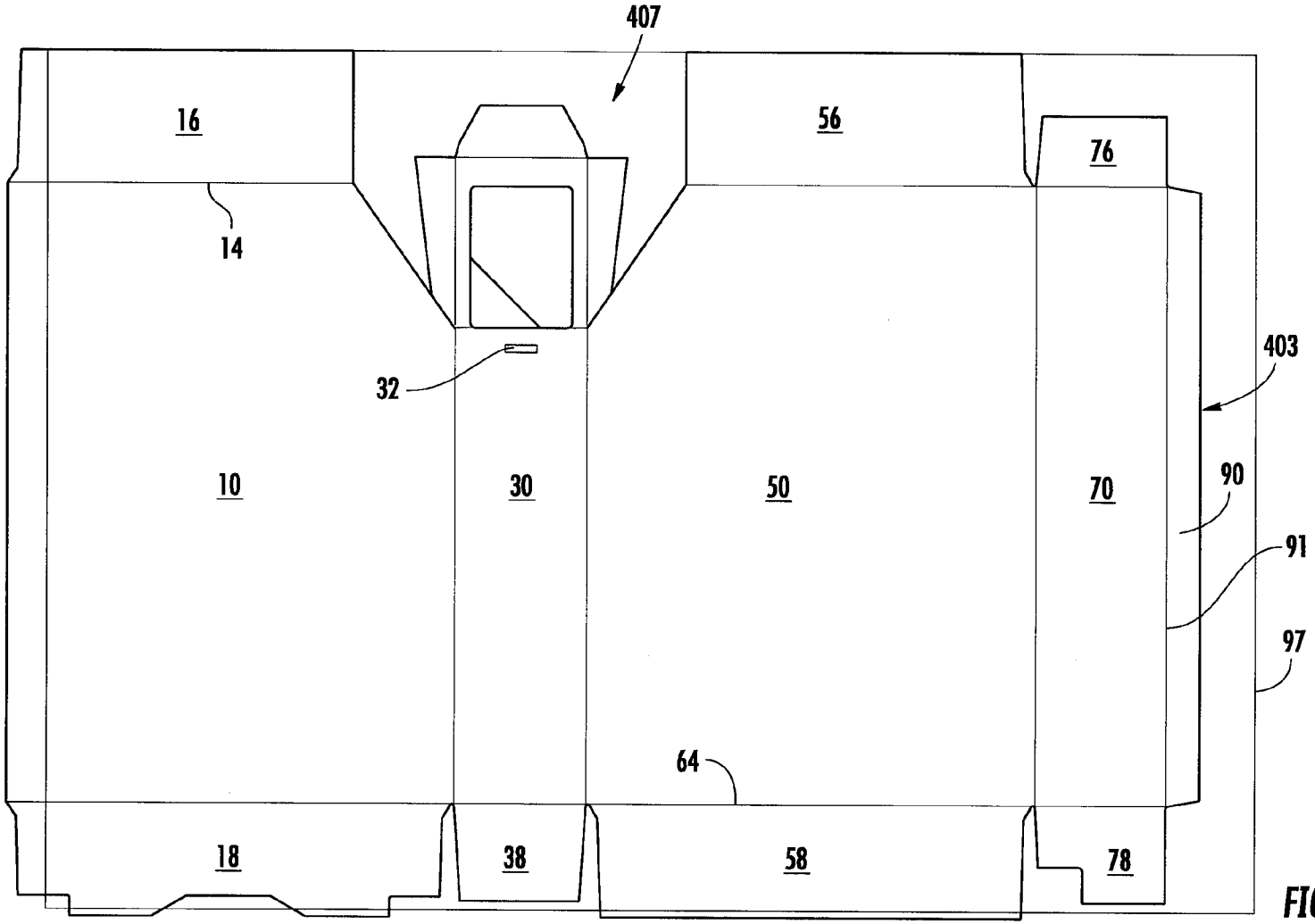
FIG. 6 is a plan view of a blank with a liner mounted thereto, in accordance with a third embodiment of this disclosure.
Figure 7:
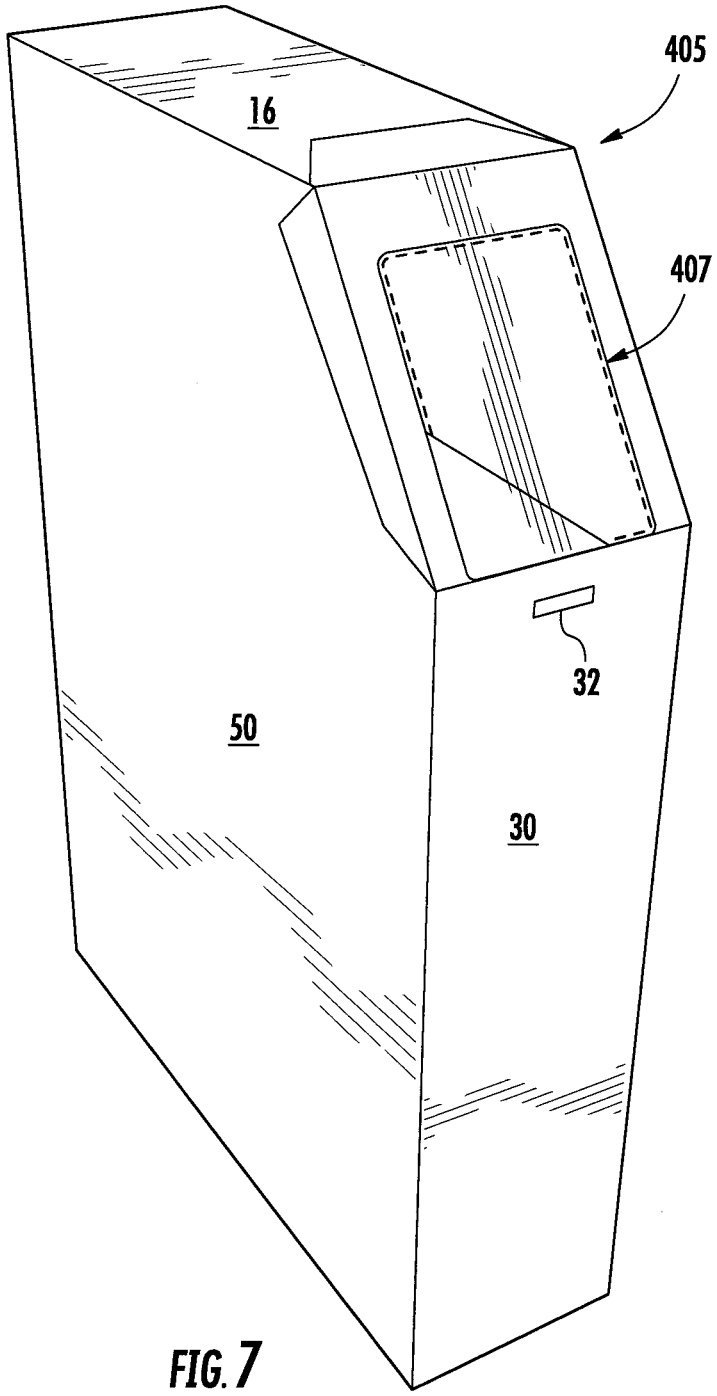
FIG. 7 is a perspective view of a carton erected from the blank of FIG. 6, in accordance with the third embodiment.

FIGS. 6 and 7 illustrate a blank a blank 403 and carton 405 in accordance with a third embodiment of this disclosure. The third embodiment may be like the first and second embodiments, except for variations noted and variations that will be apparent to those of ordinary skill in the art in view of this disclosure. Accordingly, like or similar reference numbers and/or names may be used to indicate like or similar features.

In accordance with the third embodiment, the blank 403 and carton 405 and/or fitment 200, 202' may include additional and/or different mounting features that seek to aid in the mounting of the fitment to the erected mount assembly 407/chamfered corner of the carton 405. For example and in accordance with the third embodiment, the first minor side panel 30 includes a mounting feature that may be in the form of a disruption, such as a mounting hole or slot 32, or other cut out or the like, for receiving a corresponding mounting feature (e.g., mounting protrusion) that may be formed integrally with and protrude inwardly from the inner surface of the lower front wall 204, 204' of the fitment 200, 200'. That is, a mounting protrusion that is shaped like and is smaller than the mounting slot 32 may protrude inwardly from the inner surface of the lower front wall 204, 204' of the fitment 200, 200' for being received in the mounting slot, so that the mounting protrusion is engaged to an edge of the slot for restricting the fitment 200, 202' from being pulled off of the chamfered corner of the carton 5. Alternatively or in addition, the first and second embodiments may include the mounting features of the third embodiment, and vice versa, and a variety of other mounting features are also within the scope of this disclosure.

Figure 8:
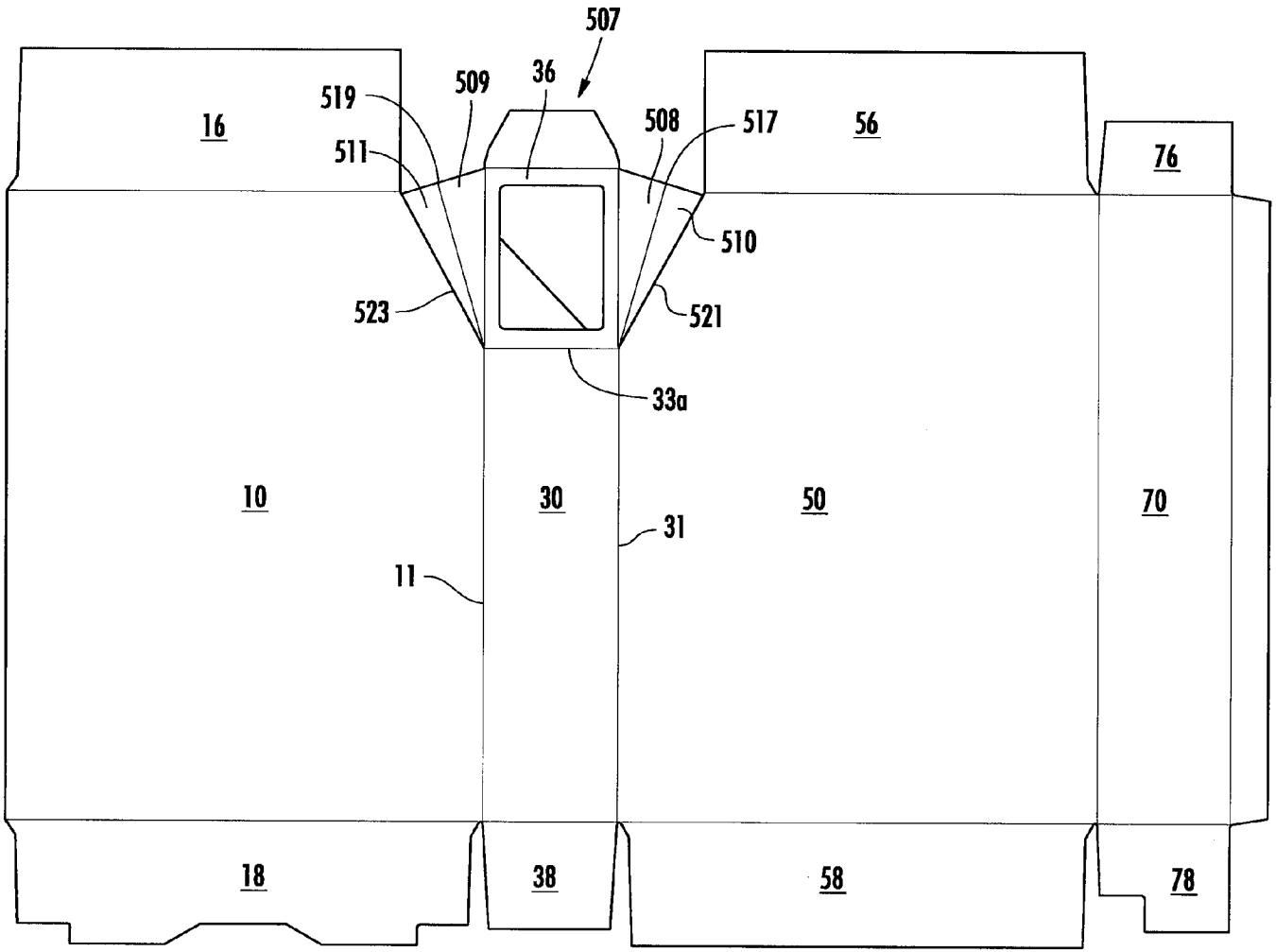
FIG. 8 is a plan view of a blank, in accordance with a fourth embodiment of this disclosure.

FIG. 8 illustrates a blank 503 in accordance with a fourth embodiment of this disclosure. The fourth embodiment may be like the first through third embodiments, except for variations noted and variations that will be apparent to those of ordinary skill in the art in view of this disclosure. Accordingly, like or similar reference numbers and/or names may be used to indicate like or similar features. A liner (not shown in FIG. 8, but see the liner 97 in FIGS. 1 and 6 for example) may optionally be mounted to the blank 503 or any other of the blanks of this disclosure.

In accordance with the fourth embodiment, the mount assembly 507 has four web or pleat panels 508, 509, 510, 511. The pleat panel 508 is partially defined by the lateral fold line 31 and oblique fold line 517. The pleat panel 509 is partially defined by lateral fold line 11 and oblique fold line 519. The pleat panel 510 is partially defined by the oblique fold line 517 and an oblique fold line 521. The pleat panel 511 is partially defined by the oblique fold line 519 and an oblique fold line 523. The pleat panel 508 is foldably connected to the dispenser panel 36 by lateral fold line 31, and to pleat panel 510 by oblique fold line 517. The pleat panel 509 is foldably connected to the dispenser panel 36 by lateral fold line 11, and to pleat panel 511 by oblique fold line 519. The pleat panel 510 is foldably connected to the second major side panel 50 by oblique fold line 521 and to pleat panel 508 by oblique fold line 517. The pleat panel 511 is foldably connected to the first major side panel 10 by oblique fold line 523, and to pleat panel 509 by oblique fold line 519.

The mount assembly 507 of the fourth embodiment may be erected as discussed above for the mount assembly 300 of the first embodiment, except that as the dispenser panel 36 of the fourth embodiment is folded inwardly about the fold line 33*a*, the pleat panels 508, 509, 510, 511 are folded outwardly and rearwardly, and the inwardly oriented faces of the pleat panels 510, 511 are respectively attached to (e.g., glued to or otherwise adhesively attached to, or attached in any other suitable manner) to the outwardly oriented faces of the side panels 50, 10, so that the pleat panels 508, 510 are in opposing face-to-face contact with one another, and the pleat panels 509, 511 are in opposing face-to-face contact with one another. Optionally, there may be adhesive material at these face-to-face contacts between the pleat panels, or the like. The combination of the foldably connected/rearward edges of the pleat panels 508, 510 and the combination of the foldably connected/rearward edges of the pleat panels 509, 511 are typically for engaging the respective ends of the mounting protrusions 209 (FIGS. 3A and 3B).

The pleat panels 508, 510 may together be referred to as a pleat. Similarly, the pleat panels 509, 511 may together be referred to as a pleat. Differently configured pleats and pleat panels 508, 509, 510, 511 may be used. Alternatively, the first through third embodiments may include the pleat panels 508, 509, 510, 511/mount assembly 507 of the fourth embodiment, and vice versa, and a variety of other pleat panels/mounting flaps/mount assemblies are also within the scope of this disclosure.

In accordance with one aspect of this disclosure, the dispenser panel 36 comprises opposite edges, and there are one or more panels (e.g., the side mounting flaps 81, 88 of FIG. 1 or the pleat panels 508, 509, 510, 511 of FIG. 8) respectively foldably connected to the opposite edges of the dispenser panel; and the connecting of the dispenser panel to each of the first and second major side panels 10, 50 comprises connecting the one or more panels (e.g., the side mounting flaps 81, 88 of FIG. 1 or the pleat panels 508, 509, 510, 511 of FIG. 8) to outer surfaces of the first and second major side panels, respectively.

Figure 9:
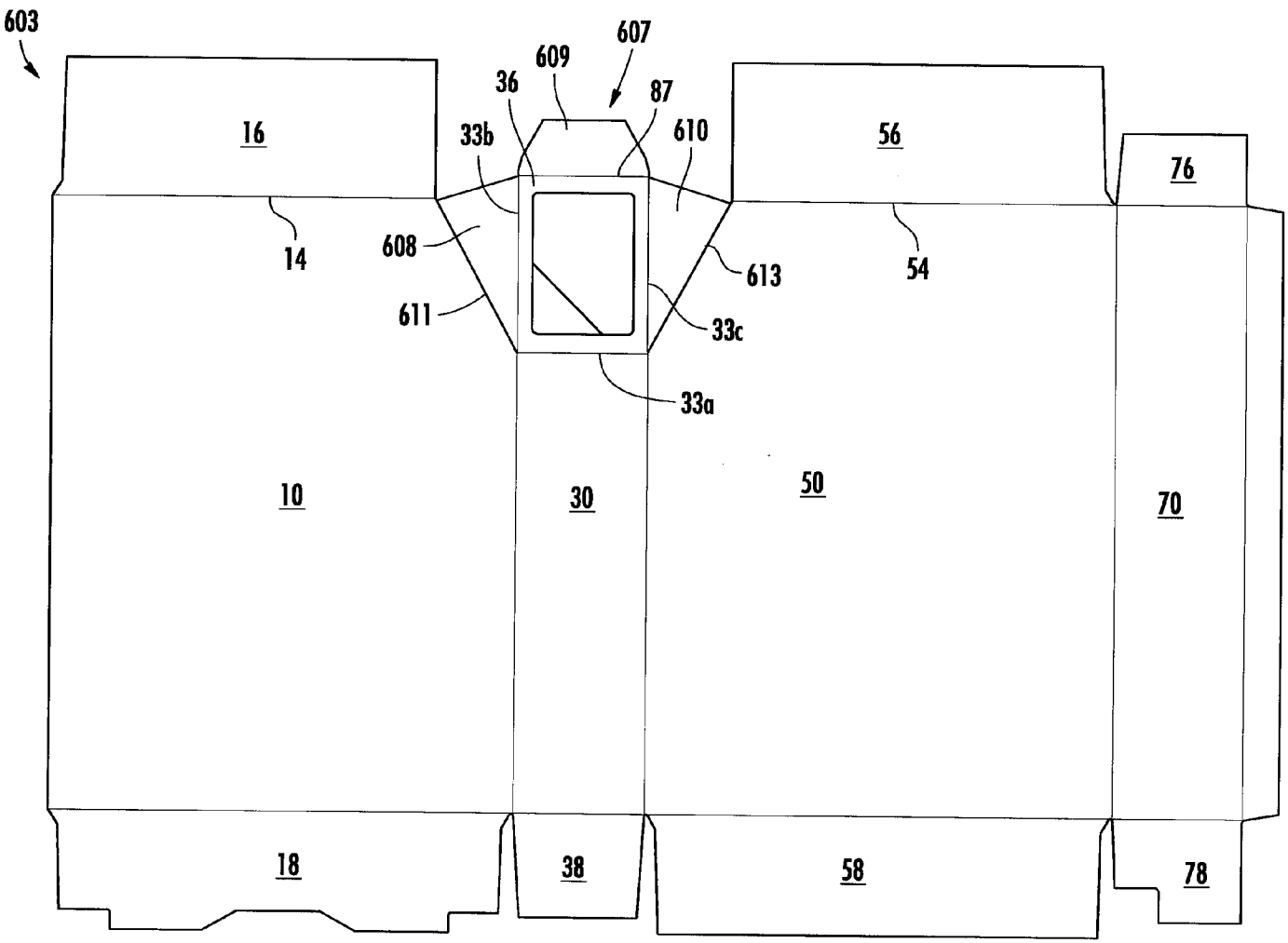
FIG. 9 is a plan view of a blank, in accordance with a fifth embodiment of this disclosure.
Figure 10B:
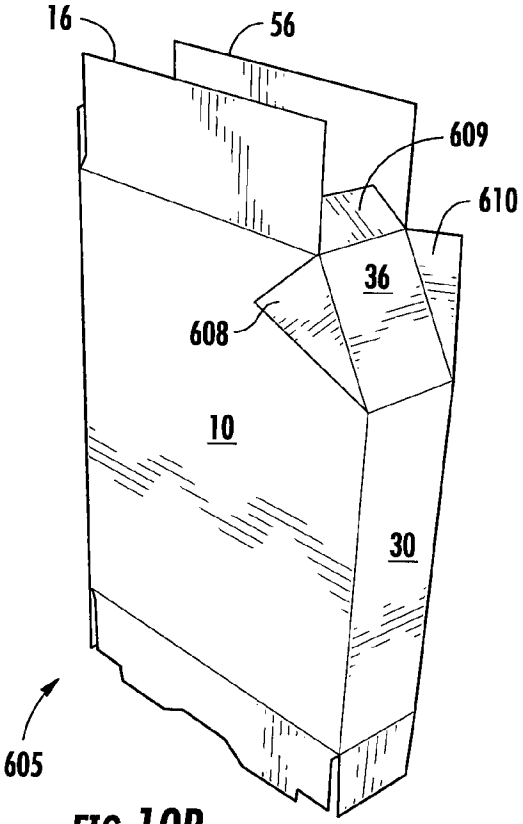
FIGS. 10A-10D illustrate a sequence for closing an upper end of a carton erected from the blank of FIG. 9, in accordance with the fifth embodiment.
Figure 10A:
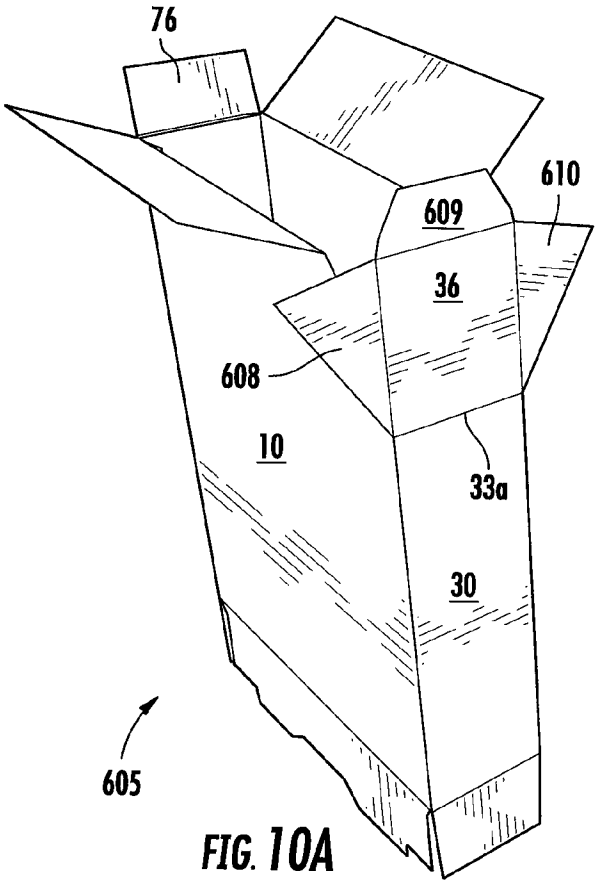
Figure 10D:
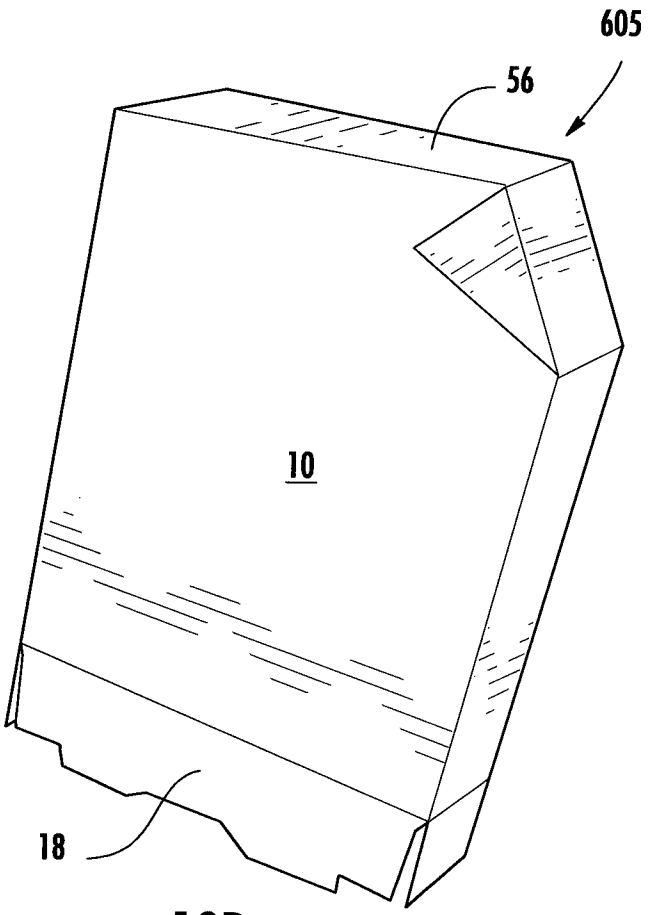
Figure 10C:
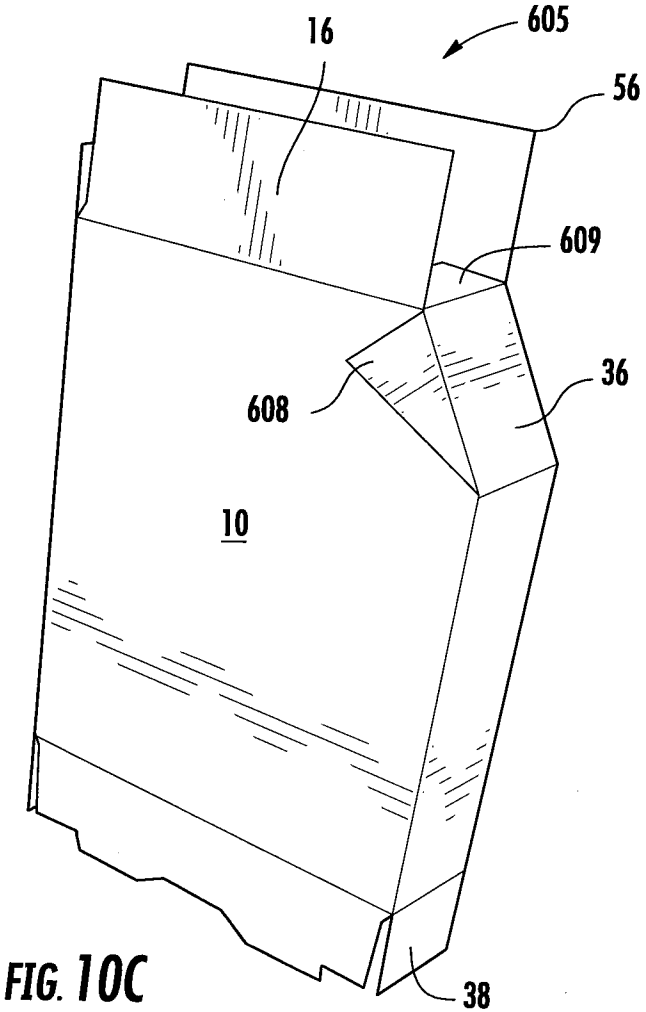

FIG. 9 illustrates a blank 603 in accordance with a fifth embodiment of this disclosure. The fifth embodiment may be like the first through fourth embodiments, except for variations noted and variations that will be apparent to those of ordinary skill in the art in view of this disclosure. Accordingly, like or similar reference numbers and/or names may be used to indicate like or similar features.

In accordance with the fifth embodiment, the mount assembly 607 has side mounting flaps 608, 610 and a top mounting flap 609 that are respectively foldably connected to the dispenser panel 36 at fold lines 33*b*, 33*c*, 87. The side and top mounting flaps 608, 610, 609 may be characterized as being wings, or wing-like flaps. The side mounting flaps 608, 610 are respectively separated from the side panels 10, 50 by cuts that are more specifically in the form of oblique slits 611, 613. Alternatively, the first through fourth embodiments may include side and top mounting flaps 608, 610, 609/the mount assembly 607 of the fifth embodiment, and vice versa, and a variety of other mounting flaps/mount assemblies are also within the scope of this disclosure.

FIGS. 10A-10D illustrate an example of a sequence for closing an upper end of a carton 605 erected from the blank 603, in accordance with the fifth embodiment. The mount assembly 607 is folded inwardly about the fold line 33*a* so that the dispenser panel 36 abuts the oblique edges of the first and second major side panels 10, 50. Then, the mount assembly 607 is further erected by folding the mounting flaps 608, 610, 609 inwardly relative to the dispenser panel 36. As partially shown in FIG. 10C, the side mounting flaps 608, 610 extend downwardly below the oblique edges of the first and second major side panels 10, 50, and the top mounting flap 609 extends rearwardly. The inwardly facing surfaces of the side mounting flaps 608, 610 are typically fixedly connected to the outwardly facing surfaces of the first and second major side panels 10, 50 with adhesive material or any other suitable mechanism. Then, the closing of the top of the carton 5 is completed by inwardly folding the top flap 76, and then inwardly folding the top flaps 16, 56, so that these top flaps at least partially overlap the top flap 76 and the top mounting flap 609. Adhesive material, or any other suitable fastening mechanism, may be applied to secure the top flaps 16, 56, 76 and the top mounting flap 609 in their closed configuration. Other sequences of closing the upper end of the carton 605 are also within the scope of this disclosure.

Figure 11:
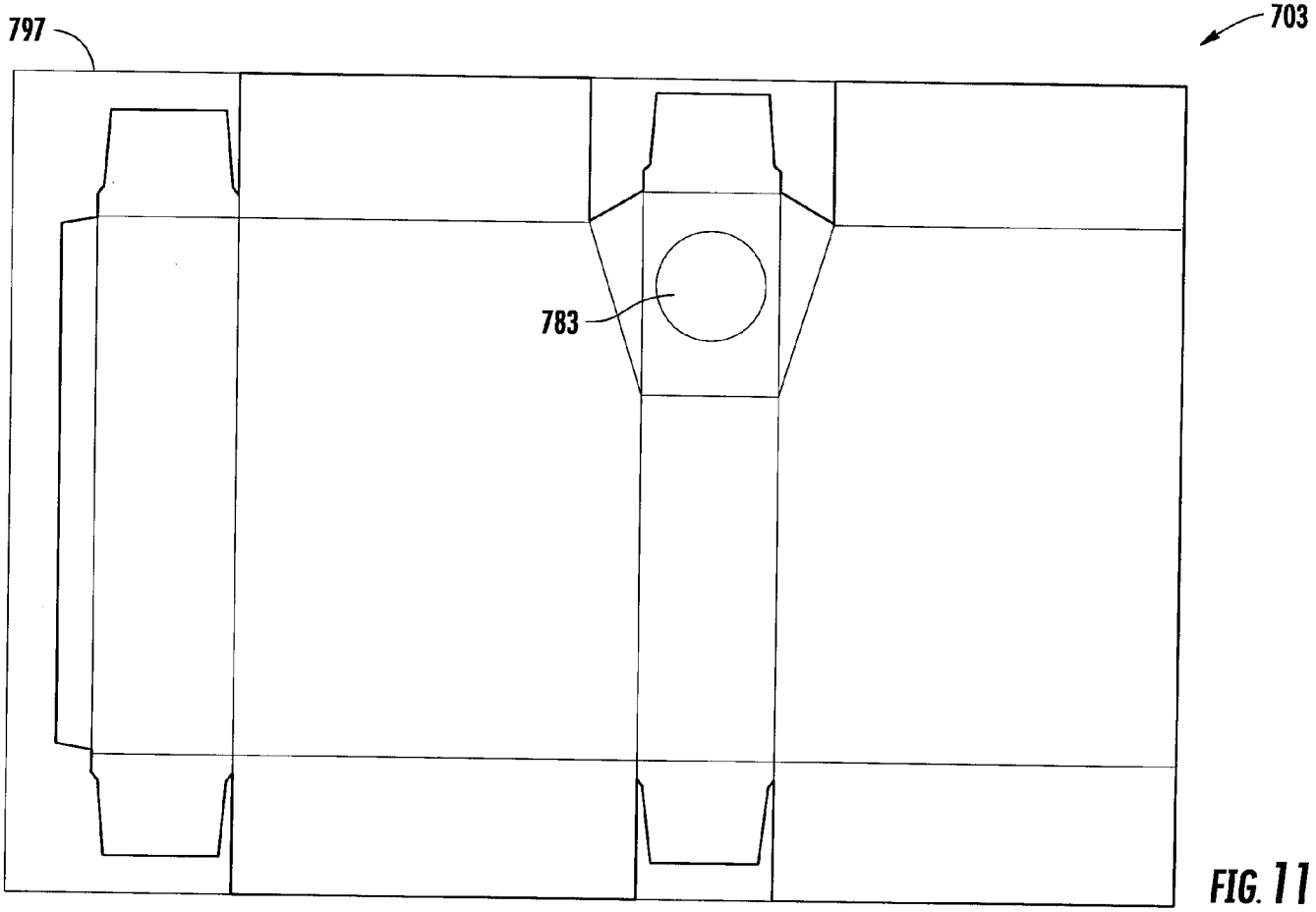
FIG. 11 is a plan view of a blank with a liner mounted thereto, in accordance with a sixth embodiment of this disclosure.

FIG. 11 illustrates a blank 703 in accordance with a sixth embodiment of this disclosure. The sixth embodiment may be like the fifth embodiment, except for variations noted and variations that will be apparent to those of ordinary skill in the art in view of this disclosure. Accordingly, like or similar reference numbers and/or names may be used to indicate like or similar features.

In accordance with the sixth embodiment, a liner 797 may be mounted to the blank 703 as shown in FIG. 11. As should be apparent from the foregoing, the liner 797 is optional and may be omitted. In accordance with the sixth embodiment, the dispenser opening 783 is round, although the dispenser opening may define a variety of different shapes.

Figure 12:
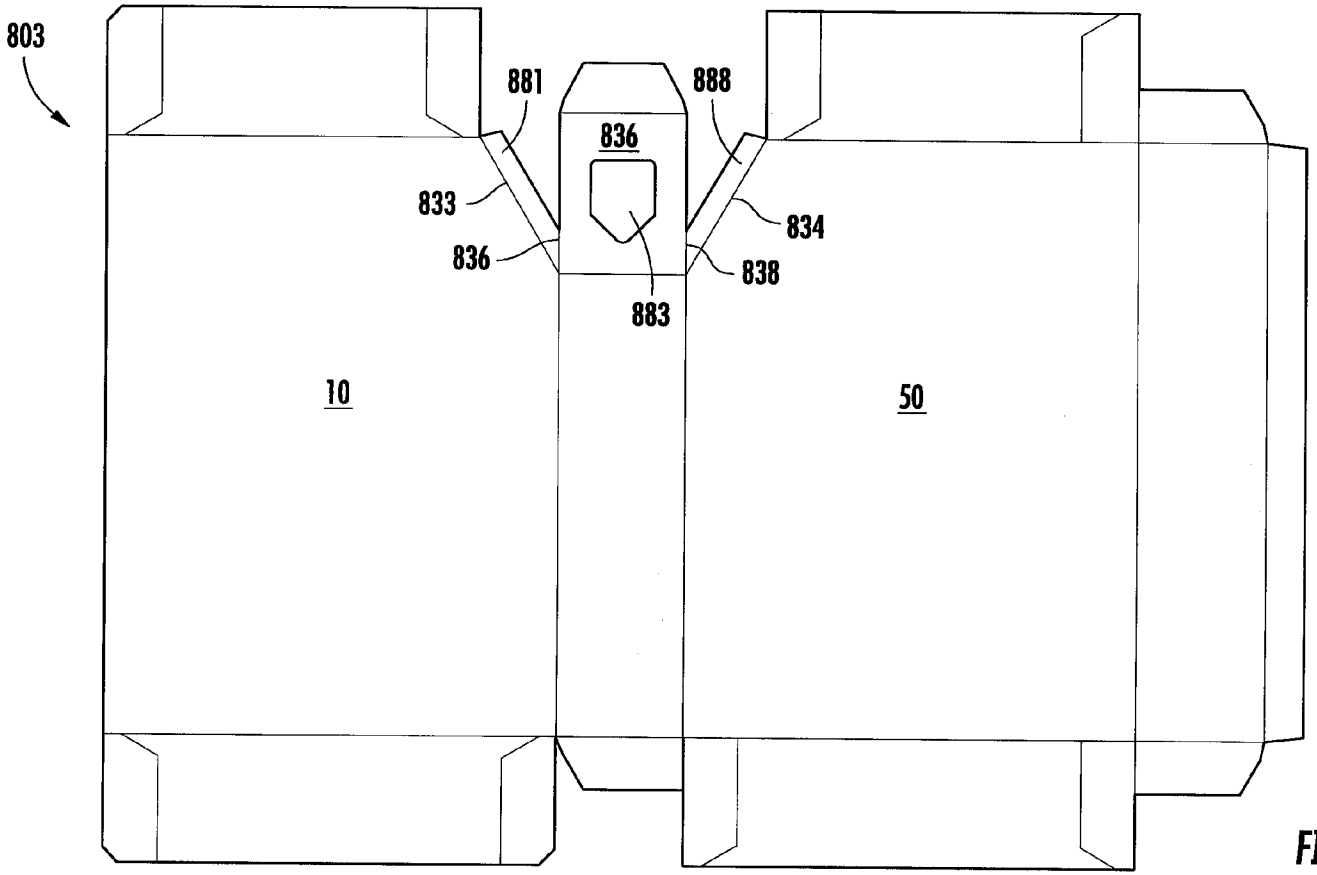
FIG. 12 is a plan view of a blank, in accordance with a seventh embodiment of this disclosure.

FIG. 12 illustrates a blank 803 in accordance with a seventh embodiment of this disclosure. The seventh embodiment may be like the first embodiment, except for variations noted and variations that will be apparent to those of ordinary skill in the art in view of this disclosure. Accordingly, like or similar reference numbers and/or names may be used to indicate like or similar features.

In accordance with the seventh embodiment, the dispenser opening 883 is substantially in the shape of a pentagon, although the dispenser opening may define a variety of different shapes. Also in accordance with the seventh embodiment, the side mounting flaps 881, 888 are respectively foldably connected to oblique edges of the side panels 10, 50 by oblique fold lines 833, 834; and separated from the dispenser panel 836 by cuts or slits 836, 838, respectively.

Alternatively, the fitments 200, 200' may be omitted or replaced with any other suitable type of fitments or pour spouts, such as reclosable fitments and reclosable pour spouts, that may be mounted to the chamfered corner/mount assembly 300, 407, 507, 607 at any suitable time, such as before and/or after the respective blank is erected. For example, the entire disclosure of each of the following documents is incorporated herein by reference: U.S. Pat. Nos. 6,152,360; 5,429,297; 5,102,485 and 4,846,915; and U.S. Patent Application Publication No. 2006/0255109. Also for example, suitable polymeric reclosable fitments and/or polymeric reclosable pour spouts may be available from Roberts PolyPro, Inc. of Charlotte, N.C. 28273

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a score line, such as a line formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small, somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

It will be understood by those skilled in the art that while the present disclosure has been discussed above with reference to exemplary embodiments, various additions, modifications and changes can be made thereto without departing from the spirit and scope of the present inventions. For example, the present inventions are not intended to be limited to the specific examples described herein. Furthermore, certain features and characteristics of each embodiment may be selectively interchanged and applied to other illustrated and non-illustrated embodiments of the disclosure. That is, the above examples are in no way intended to limit the scope of the present inventions. It will be understood by those skilled in the art that while the present disclosure has been discussed above with reference to exemplary embodiments, various additions, modifications and changes can be made thereto without departing from the spirit and scope of the inventions as set forth in the claims.

What is claimed is:

1. A carton for containing and dispensing contents, the carton comprising:

a plurality of panels respectively foldably connected to one another, the plurality of panels extending around an interior of the carton, and the plurality of panels comprising opposite first and second major side panels, opposite first and second minor side panels that are each smaller than the first and second major side panels, a bottom panel at least partially closing a bottom end of the carton, a top panel at least partially closing a top end of the carton, and an oblique panel at least partially defining an outer chamfered corner of the carton, so that the chamfered corner comprises the oblique panel, wherein the oblique panel extends between the first and second major side panels, the oblique panel extends between the top panel and the first minor side panel, and the oblique panel extends obliquely relative to each of the first and second major side panels, the first and second minor side panels, and the top and bottom panels, the chamfered corner further comprises at least one flap foldably connected to the oblique panel and in face-to-face contact with the outer surface of one of the first major side panel, the second major side panel, and the top panel; and a dispenser defined in the chamfered corner, the dispenser being for use in dispensing contents from the interior of the carton.

2. The carton according to claim 1, wherein:

the oblique panel comprises opposite upper and lower edges, and opposite first and second side edges;

the lower edge of the oblique panel is adjacent to and extends along an upper edge of the first minor side panel;

the upper edge of the oblique panel is adjacent to and extends along an edge of the top panel;

a first side edge of the oblique panel is adjacent to and extends along an oblique edge of the first major side panel; and a second side edge of the oblique panel is adjacent to and extends along an oblique edge of the second major side panel.

3. The carton according to claim 1, wherein the dispenser comprises a hole, and the hole extends through the oblique panel.

4. The carton according to claim 1, wherein the dispenser comprises a disruption in the chamfered corner, and the disruption circumscribes a central portion of the oblique panel.

5. The carton according to claim 4, wherein the disruption comprises a tear line that is for being torn for removing at least the central portion of the oblique panel from the chamfered corner, to at least further define a dispenser hole in the chamfered corner.

6. The carton according to claim 4, wherein the disruption comprises a tear line defined in the oblique panel.

7. The carton according to claim 1, wherein:

a lower edge of the oblique panel is connected by a fold line to an upper edge of the first minor side panel;

the oblique panel is connected to the top panel; and the oblique panel is connected to each of the first and second major side panels.

8. The carton according to claim 7, wherein the at least one flap of the chamfered corner comprises:

a first flap connected by a fold line to an upper edge of the oblique panel, the first flap being mounted to the top panel;

a second flap connecting the oblique panel to the first major side panel; and a third flap connecting the oblique panel to the second major side panel.

9. The carton according to claim 7, wherein the chamfered corner further comprises:

a flap connected by a fold line to an upper edge of the oblique panel, the first flap being mounted to the top panel;

a pleat connected between a first side edge of the oblique panel and an oblique edge of the first major side panel; and a pleat connected between a second side edge of the oblique panel and an oblique edge of the second major side panel.

10. The carton according to claim 7, wherein the at least one flap of the chamfered corner comprises:

a first flap connected by a fold line to an upper edge of the oblique panel, the first flap being mounted to the top panel;

a second flap connected by a fold line to a first side edge of the oblique panel, the second flap being mounted to the first major side panel; and a third flap connected by a fold line to a second side edge of the oblique panel, the third flap being mounted to the second major side panel.

11. The carton according to claim 10, comprising at least one configuration selected from the group consisting of:

the first flap being mounted to an outer surface of the top panel;

the second flap being mounted to an outer surface of the first major side panel; and the third flap being mounted to an outer surface of the second major side panel.

12. The carton according to claim 10, wherein:

the second flap is mounted to an outer surface of the first major side panel; and the third flap is mounted to an outer surface of the second major side panel.

13. The carton according to claim 1, in combination with a fitment, wherein the fitment is mounted to the chamfered corner of the carton, the fitment is for use in dispensing contents from the interior of the carton by way of the dispenser, and the fitment comprises:

a base comprising a rearward receptacle that is in receipt of the chamfered corner of the carton, so that the chamfered corner extends into the rearward receptacle, and a passageway extending through the base from the receptacle to a front opening of the passageway, and a lid for use in closing and opening the front opening to the passageway; and a connector movably connecting the lid to the base.

14. A blank for forming a carton for containing a product, the blank comprising:

a minor panel comprising first and second edges that are opposite from one another, and third and fourth edges that are opposite from one another, the third and fourth edges extending crosswise to the first and second edges;

a dispenser panel connected to the third edge of the minor panel by a fold line;

first and second major side panels respectively foldably connected to the first and second edges of the minor panel, each of the first and second major side panels being larger than the minor panel, each of the first and second major side panels comprising an oblique edge, the oblique edges extending outwardly from proximate respective ends of the fold line, and the oblique edges extending divergently with respect to one another in an outward direction away from the fold line;

a flap foldably connected to the dispenser panel for being positioned in face-to-face contact with the outer surface of one of the first major side panel and the second major side panel when the carton is formed from the blank; and the dispenser panel being positioned between the oblique edges respectively of the first and second major panels.

15. The blank according to claim 14, further comprising:

end flaps respectively foldably connected to opposite end edges of the first major panel;

end flaps respectively foldably connected to opposite end edges of the second major panel; and a second minor panel connected to a side edge of the first major panel or a side edge of the second major panel.

16. The blank according to claim 14, wherein the dispenser panel comprises a tear line, the tear line is adjacent a central portion of the dispenser panel, and the tear line is for being torn for removing at least the central portion of the dispenser panel to at least further define a dispenser hole in the dispenser panel.

17. The blank according to claim 14, further comprising:

a flap foldably connected to the oblique edge of the first major panel; and a flap foldably connected to the oblique edge of the second major panel.

18. The blank according to claim 14, wherein:

a first edge of the dispenser panel is foldably connected to the third edge of the minor panel;

the dispenser panel comprises a second edge that is opposite the first edge of the dispenser panel; and the blank further comprises a flap foldably connected to the second edge of the dispenser panel.

19. The blank according to claim 18, wherein the dispenser panel comprises opposite third and fourth edges that extend crosswise with respect to the first and second edges of the dispenser panel, and the blank further comprises:

a flap foldably connected to the third edge of the dispenser panel; and a flap foldably connected to the fourth edge of the dispenser panel.

20. The blank according to claim 18, wherein the dispenser panel comprises opposite third and fourth edges that extend crosswise with respect to the first and second edges of the dispenser panel, and the blank further comprises:

a plurality of pleat panels connected between the third edge of the dispenser panel and the oblique edge of the first major panel; and a plurality of pleat panels connected between the fourth edge of the dispenser panel and the oblique edge of the second major panel.

21. A method of at least erecting a carton having a chamfered corner, the method comprising:

partially erecting the carton from a blank, so that opposite first and second major side panels respectively extend from opposite edges a minor side panel, the blank comprises a minor panel comprising first and second edges that are opposite from one another, and third and fourth edges that are opposite from one another, the third and fourth edges extending crosswise to the first and second edges, a dispenser panel connected to the third edge of the minor panel by a fold line, and a flap foldably connected to the dispenser panel;

folding the dispenser panel inwardly relative to the minor side panel, toward each of oblique edges of the first and second major side panels, so that the dispenser panel extends obliquely and at least partially defines the chamfered corner of the carton; and connecting the dispenser panel to each of the first and second major side panels, the flap being positioned in face-to-face contact with the outer surface of one of the first major side panel and the second major side panel.

22. The method according to claim 21, wherein:

the dispenser panel comprises opposite edges, and the flap comprises a first flap and a second flap respectively foldably connected to the opposite edges of the dispenser panel; and the connecting of the dispenser panel to each of the first and second major side panels comprises connecting the first flap to the outer surface of the first major side panel, and connecting the second flap to the outer surface of the second major side panel.

23. The method according to claim 22, further comprising mounting a fitment to the chamfered corner of the carton, comprising causing relative movement between the carton and the fitment so that the chamfered corner is received in a rearward receptacle of the fitment, and opposite inwardly protruding mounting members of the fitment respectively engage behind edges of the first flap and second flap for restricting the fitment from being pulled off of the chamfered corner of the carton.

* * * * *